US010563333B2

(12) United States Patent
Miller

(10) Patent No.: US 10,563,333 B2
(45) Date of Patent: Feb. 18, 2020

(54) SIMULATED HAND-WASH WASHING MACHINE

(71) Applicant: Katherine Thuy Miller, San Leandro, CA (US)

(72) Inventor: Katherine Thuy Miller, San Leandro, CA (US)

( * ) Notice: Subject to any disclaimer, the term of this patent is extended or adjusted under 35 U.S.C. 154(b) by 0 days.

(21) Appl. No.: 15/655,888

(22) Filed: Jul. 21, 2017

(65) Prior Publication Data

US 2019/0024278 A1 Jan. 24, 2019

(51) Int. Cl.

| | |
|---|---|
| ***D06F 15/00*** | (2006.01) |
| ***D06F 1/02*** | (2006.01) |
| ***D06F 5/02*** | (2006.01) |
| ***D06F 15/02*** | (2006.01) |
| *D06F 13/00* | (2006.01) |

(52) U.S. Cl.

CPC ..... *D06F 15/00* (2013.01); *D06F 5/02* (2013.01); *D06F 15/02* (2013.01); *D06F 1/02* (2013.01); *D06F 13/00* (2013.01)

(58) Field of Classification Search

CPC ... D06F 1/02; D06F 5/02; D06F 13/00; D06F 15/00

See application file for complete search history.

(56) References Cited

U.S. PATENT DOCUMENTS

| | | | | |
|---|---|---|---|---|
| 1,491,927 A * | 4/1924 | Sedita | D06F 15/00 | 68/28 |
| 4,787,110 A * | 11/1988 | Barone | C11D 17/0069 | 68/132 |
| 4,912,947 A * | 4/1990 | Dai | D06F 15/00 | 58/134 |
| 5,231,857 A * | 8/1993 | Rew | D06F 13/00 | 68/106 |

* cited by examiner

*Primary Examiner* — Benjamin L Osterhout

(74) *Attorney, Agent, or Firm* — Imperium Patent Works; Amir V. Adibi; Andrew C. Palmer

(57) ABSTRACT

This is a new style of simulated hand wash automated washing machine using zigzag-shape robot hands, made by light yet strong metal, that is initiated and facilitated movements by solenoid electric-mechanical linear actuators. The mechanism to transfer the movements from the actuators works similar to the bike mechanism from which transfers the movement onto belts and these belts will pull and push the zigzag-shape robot hands. The movements received by these robot hands on the walls and the floor of the machine shell next are transmitted onto a washer ball made up of sustainable, light, flexible, yet little stretchy type of rubber. There are other benefits from this new style washer that is environmental-friendly, low cost (building, repairing, packaging, shipping, storage, handling, etc.), and more beneficial.

13 Claims, 21 Drawing Sheets

WASH MODE

End of wash mode last cycle

The ball returns to its original spherical shape. The drain valve opens to drain out all dirty water. When the drain water flow stops, the drain sensor sends concentric signal to the control panel. Control panel then sends signal to the hot/cold water valves. The valves open to pour water into the ball.

When water is poured into the ball for about ten seconds, the control panel sends signal to all the robot hand sensors. The floor rotex hands are still the first to rise like in wash mode order; next, two pairs of opposite robot hands push and pull and then the next two pairs left to do the same. Lastly, the floor rotex hand descend and the ball returns to its original position.

The cycle repeat itself as the same order. The number of cycles for this first rinse is different for different wash mode selected from the beginning.

When the last cycle is finished, the drain valve opens to drain all the dirty water out. Control panel sends signal to the hot/cold water valves to pour water in for the second rinse. The second rinse happens the same manner as the first rinse. At the end, there is a musical alarm to notice the clean clothes are ready to take out for drying.

Note: - In ball cleaning mode: it is the same manner as any wash mode, but the cycle number is less.
- In extra rinse choice: after second rinse, the extra rinse kicks in the same manner.

RINSE MODE

FIG. 14

SIMULATED HAND-WASH WASHING MACHINE

TECHNICAL FIELD

The described embodiments relate to garments, and more particularly garments that support post-operative procedures and treatment.

BACKGROUND INFORMATION

In our modern times, washing machines have replaced a majority of hand-washing chores. However, there are special situations in which people still prefer to do hand-washing. This is because the current washing machines have certain drawbacks, for example, they cause damage, fraying, disfiguration, and wearing of clothes and fabric items because the mechanisms of hard washing machines cause fabrics to constantly thrust-around inside the hard surface of a metal drum within the washing machine agitating with spinning water.

This Simulated-Hand-Wash SHW washer is a kind of soft-wash mechanism. Fabrics are interactive within a spherical washer ball which is made from rubber with reasonable low-force motions created by sixteen (16) robot hands that pull and push similarly to hand washing. This new mechanism decreases fabric damage, fraying, and wear. It also decreases wrinkles and disfiguration of the clothes after wash since clothes and other fabric items do not have to go through the interaction with agitating spinning water against a hard metal drum and the compressing them together with the high speed spin to extract water at the end of washing mode. They are instead inside a soft ball with "soft" motions. This SHW washer uses less water and electricity and some other advantages addressed later in this application.

SUMMARY

This is a new style of automated washer that simulates hand-washing mechanism; washing and squeezing motions are created by sixteen robot hands. (16 consisting of 12 on 4 side walls and 4 at floor). These robot hands are run by their belts sliding back and forth on chains that, in turn, oscillate back and forth on wheels that are attached to their correspondent six (6) electric-mechanical linear solenoid actuators on walls and floor. (see FIGS. 1, 2, 3, and 4)

These robotic hand movements are transferred onto a washer ball made of rubber that is light weight, strong, flexible yet little stretchy, described in more detailed in the description.

These robot hands on the side walls and floor create movements similar to hand-washing movements. These motions are applied onto the washer ball and eventually onto the clothes inside, and are not damaging to fabrics as in the current style of washing machines. (FIGS. 1, 2, 3, and 4)

Twelve (12) wall and four (4) floor zigzag spring-structure robot hands disposed along ends are attached onto the walls by the bases that hold the wheels and chains. On the other side, each of these robot hands, connect onto a plastic plate that has a strong industrial Velcro attachment that attaches to the corresponding Velcro piece on the washer ball, which is a container for dirty clothing, linens, etc. The washer ball is hung at the center of the machine shell by these strong industrial Velcro surrounding it. (FIGS. 1, 2, 3, and 4)

Next to the floor robot hand on either side of the plastic drain solenoid valve and plastic cap are the two scales with weight sensors. They weigh the loads to adjust correspondent volumes of hot/cold water that should be used for a specific load and wash mode. These weight sensors (light and strong metal and plastic as appropriate parts) are particularly functioning at the beginning before the washer starts running. After that, its function is mainly for supporting weight bearing the ball besides the floor robot hands. (see FIGS. 1, 2, 3, and 4)

The whole compound of solenoid valve system with sensors, is made of strong, light, flexible yet little stretching plastics on different stations. A station to control hot/cold water, a station to control the detergent and additives delivery, and a station to control draining water, (FIGS. 9, 10, and 11) are monitored by a well-circuit control panel (FIG. 12, 15). The control panel has an interactive interface on the front view of the machine shell (FIG. 12), and is computerized and programmed to different wash modes (wash, rinse, clean ball, drain) (FIG. 13, 14) thereby accommodating to users' purposes at different times.

This SHW washer uses less water and electricity. The SHW washer is built with materials and mechanisms that decrease costs as compared to costs associated with traditional washing machines. The SHW washer is also made into separate parts that can be assembled and disassembled so it is easy to handle, to package, to store, to transfer, to ship, to save space, to replace parts instead of the whole new machine and to reduce cost of worn-out renewal and repair, etc.

BRIEF DESCRIPTION OF THE DRAWINGS

FIG. 14 is a flowchart of a method in accordance with another novel aspect.

DETAILED DESCRIPTION

Manufacture and Operation of SHW Washer Machine:

The measurements for the components of robot hands, balls, and other auxiliary structures below are initial estimations so these numbers of measurements are subject to adjustment and monitoring when needed for purposes of manufacturing the properly functional SHW Washer machine.

The washer ball is made of any kind of rubber that is light-weight, flexible, strong, sustainable to pressure and repetitive motions, but exhibits little stretching. The washer ball is hung at the center of the machine shell by strong industrial velcro surrounding it. The washer ball has two layers: the thickness of the inner layer is a quarter of an inch (0.25) while the thickness of the outer layer is 0.19 inch. The inner layer is a net layer, in which each hole is a square with one side measuring a quarter of an inch (0.25). The outer layer is a solid layer that has the central bottom with a drain hole outlet. (FIG. 1 to FIG. 8).

Figure 1:
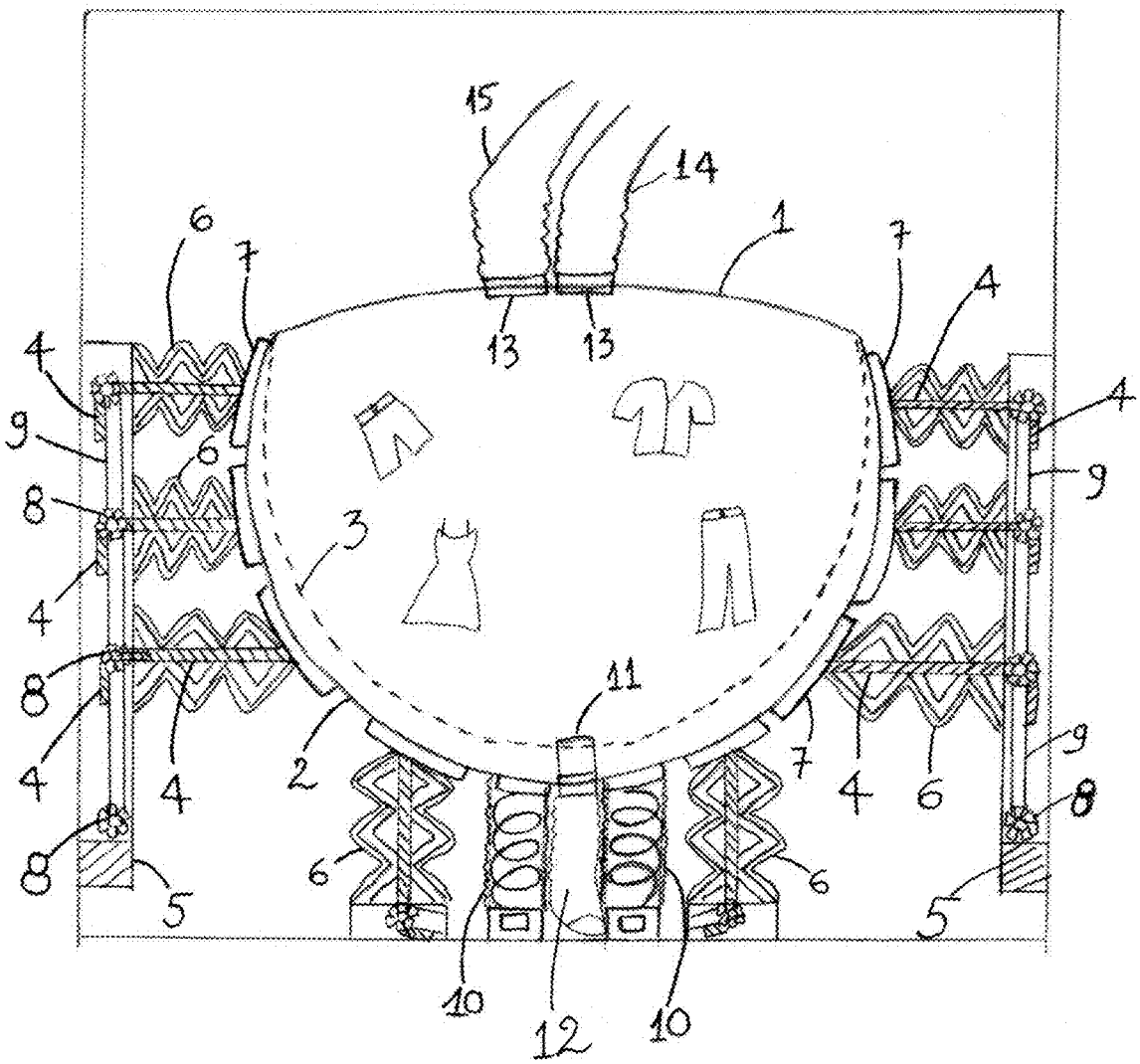
FIG. 1 is a diagram of a cross-sectional view of robot hands of a SHW washer in operation.

The size of a SHW washer shell (FIG. 12) is almost the size of any average washer. The SHW washer shell is made up of hard, strong, light plastics or metal. The SHW washer shell is a square cube of about thirty five (35) inches on each side. The SHW washer shell is a cubic square machine of sufficient volume to contain its main part, the washer ball (FIG. 1 to FIG. 8), which is almost spherical, with a diameter of about twenty four (24) inches or radius of twelve inches (12). The washer ball is absolutely spherical at the four-fifths (4/5) bottom. The one-fifth (1/5) top is a more flattened-out dome shape as compared with the lower part. This one-fifth top is an imaginary dome cut from a larger ball with diameter of 20.4 inches. The flattened-out dome-shape lid on top of the spherical dome below is similar to a lid cover the round bowl below it. (FIGS. 1, 6, and 7) (Calculations are described below) The ball is hung firmly in at the center of its outer shell by the strong industrial velcro. (FIG. 1, 2, 3, 4, 12)

The distance from the ball perpendicular to the wall at the central robot hand is five and a half (5.5) inches on each of four side wall, five and a half (5.5) inches to the central of the floor of the machine shell, where the robot hands are attached. The distance increases from the ball to the wall diagonally as the other robot hands attach to it. These distances determine how far the robot hands can push and pull to initiate movements. (FIGS. 1, 2, 3, and 4)

The height of the flattened out dome-shape lid is one tenth (1/10) of the ball diameter. The lid is sealed to the lower part of the ball. The thickness of the washer ball wall inner layer is a quarter of an inch (0.25) while the outer layer is 0.19 inch. (FIGS. 1, 3, 4, and 8)

Figure 8:
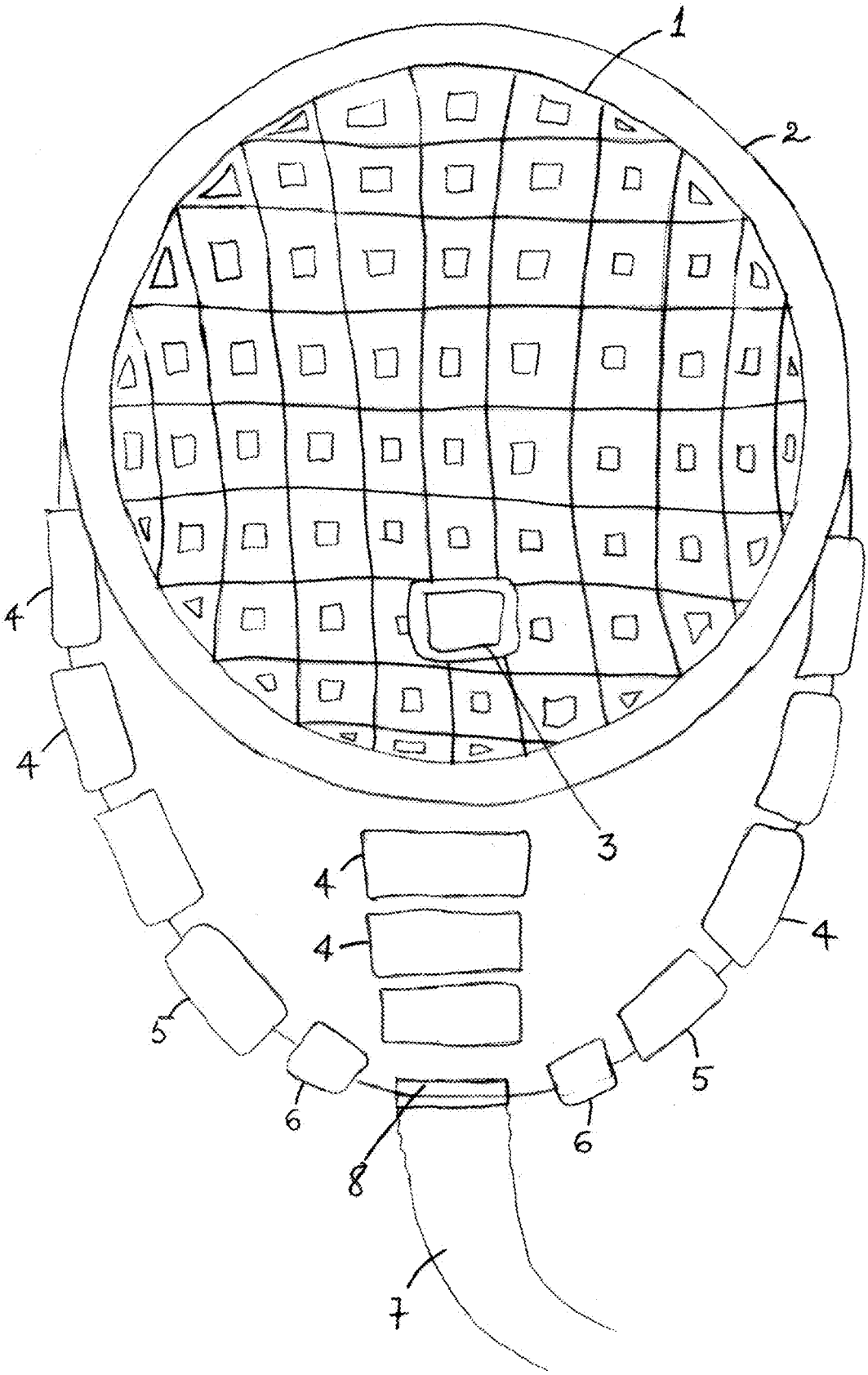
FIG. 8 is a diagram of an inner and partial front view of the washer ball.

Four-fifths (4/5) of the lower part inner side of the washer ball has two layers with the thicknesses of the two layers as explained above. The inner layer (0.25 inch thickness) is of a net structure, and each hole of the net is a square with a quarter (0.25) inch on each side, with the same material as the outer layer with thickness of 0.19 inch. The inner net layer is for draining water into the lower outer layer and into the drain hole outlet by gravity. The net inner layer has the drain cap at its center bottom that is contacted to the outer layer by the solenoid drain valve and drain hose. (FIG. 8)

Calculations related to the volumes of washer ball and the flattened-out dome-shaped lid are set forth below.

The machine shell is a square cube where one side is 35 inches. The ball diameter is 24 inches (radius r=12 inches). The ball has a 4/5 bottom that is absolutely spherical, and a 1/5 top that is a flattened out dome-shape lid sealed with the bottom.

Absolute spherical ball volume=4/3*pi*r^3=4/3*3.1416*12^3=7,238.246 inches cube

So, the 4/5 bottom ball volume=4/5*7,238.24=5,790.59 inches cube=25.06 US gallons=V1

The total volume of the washer ball V is the sum of the volume of the 4/5 lower spherical part of the ball V1, and the volume of the dome-shape lid V2.

$$V\text{ washer ball}=V1+V2 \quad (1)$$

Next, the dome-shape lid volume V2 is calculated. The dome-shape lid is flattened-out as compared with the spherical lower part of the washer ball. The dome-shape lid is taken from cutting a dome out of a larger spherical ball. To calculate this dome-shape lid volume, we need to have the radius R of that large spherical ball wherein the lid is taken from and h, the height of the dome, which is already known as 1/10 of the washer ball diameter.

Calculate dome volume V2: according to the illustration picture and the reference formula, we need radius and height of the dome-shaped lid. We call dome-shape lid sphere radius as Ra, the height of the dome is ha, and the small radius of the imaginary bottom is r; r is indeed the same radius of the dome of the lower part of the ball.

According to reference below:

(Reference: http://www.sangakoo.com/en/unit/the-spherical-dome-surface-area-and-volume) The spherical dome: Surface area and volume: The spherical dome is the figure resulting from having made a flat cut in a sphere. Surface area=A=2pi*R*h, Volume=V=1/3 pi*h^2*(3R−h) with R=(r^2+h^2)/2h We have, $$\text{Dome-shape lid volume } V2=1/3\ \text{pi}*ha\hat{}2*(3Ra-h) \quad (2)$$

Ra=(r^2+ha^2)/2ha

Ra is the radius of the large sphere where the dome-shape lid is cut and taken out; r is the radius of the imaginary bottom of the dome-shape lid, which is indeed where the dome-shape lid is sealed into the lower 4/5 part of the spherical washer ball.

We have:

ha of the dome=1/10 ball diameter=1/10*24 inches=2.4 inches

Now, we need to calculate Ra.

To be able to calculate Ra of the dome-shape lid, we need to calculate r of the dome-shape lid (again, the same as the imaginary circle where the lid is sealed to the lower part of the ball) so we can use the formula:

$$Ra=(r\hat{}2+ha\hat{}2)/ha\hat{}2$$

To be able to calculate r of the dome-shape lid of the washer ball same as the r of the dome of the lower part of the ball, we use the formula R=(r^2+h^2)/2h or r=√(2hR−h^2) With: h=4/5*24 inches=19.2 inches and R=12 inches. Plug these values into the formula, we have: r=√(2*19.2*12−19.2*19.2)=√(460.8−368.64)=√92.16, r=9.6 inches. Now we can calculate Ra, again using the formula R=(r^2+h^2)/2h, Ra=(r^2+ha^2)/2ha=(9.6^2+2.42)/2*2.4=(92.16+5.76)/4.8=97.92/4.8=20.4 inches. So, the dome-shape lid volume, we plug into equation (2) is V2=1/3 pi*ha^2 (3Ra−ha)=1/3*3.1416*2.4^2

(3*20.4−2.4)=356.909*357 inches cube #1.54 US gallons. Total volume of the washer ball with two domes, from equation (1) V=V1+V2=25.06+1.54=26.6 US gallons. So, the washer ball can retain a maximum volume of 26.6 US gallons. In reality, the washer ball is filled, even with heaviest load, with about seven (7) gallons maximum for each wash or rinse mode, less than one third of its full tankage. This extra volume allows the washer ball to sustain the pressure and configuration changes under the robot hands motions. This also explains the reason the ball should not be absolutely round, but a little flattened out on the upper part of the lid as to leave room for configuration changes during washing, rinsing, and draining. (FIGS. 1, 2, 3, and 4)

The outer and inner layer is about one (1) inch apart. The furthest distance of one inch is at the central bottom of the ball and the distance gets shorter and shorter gradually until the two layers meet and glue together at fourth fifth (⅘) of top of the ball. This net structure inner layer is for draining the water into the outer layer via small square holes of the inner net (each square hole is about a quarter of an inch each side) with gravity and eventually draining out of the ball through the drain hole outlet controlled by the solenoid drain valve. (FIG. 8, 9)

At the central bottom of the ball is a drain hole outlet of about one and a half (1.5) inches in diameter, hooked up with the drain hose to outside that is attached to a solenoid plastic drain valve that can open and close in a timely manner. (FIG. 1, 3, 4, 6, 7)

Figure 5:
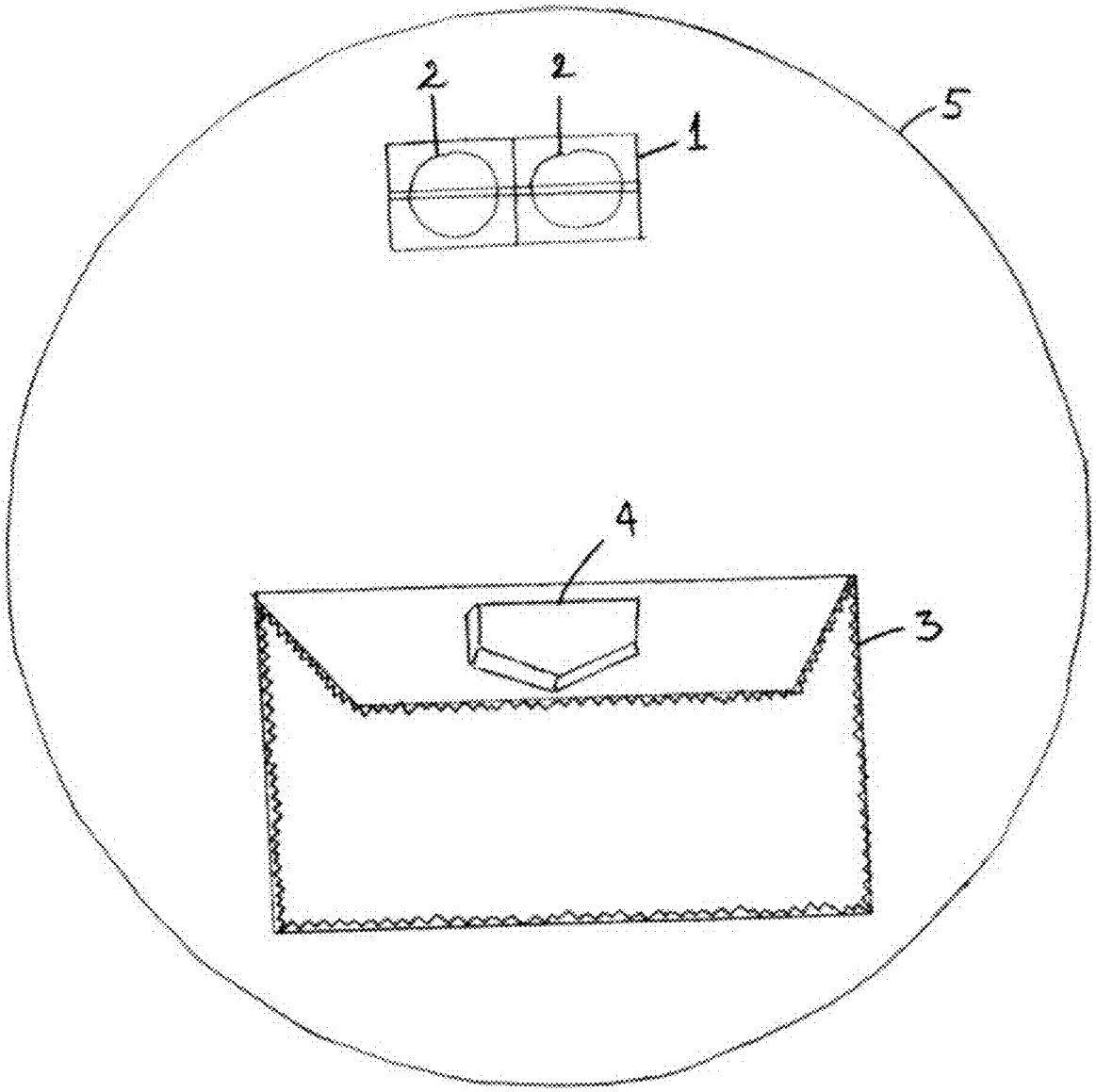
FIG. 5 is a diagram of a lid of the washer ball.
Figure 6:
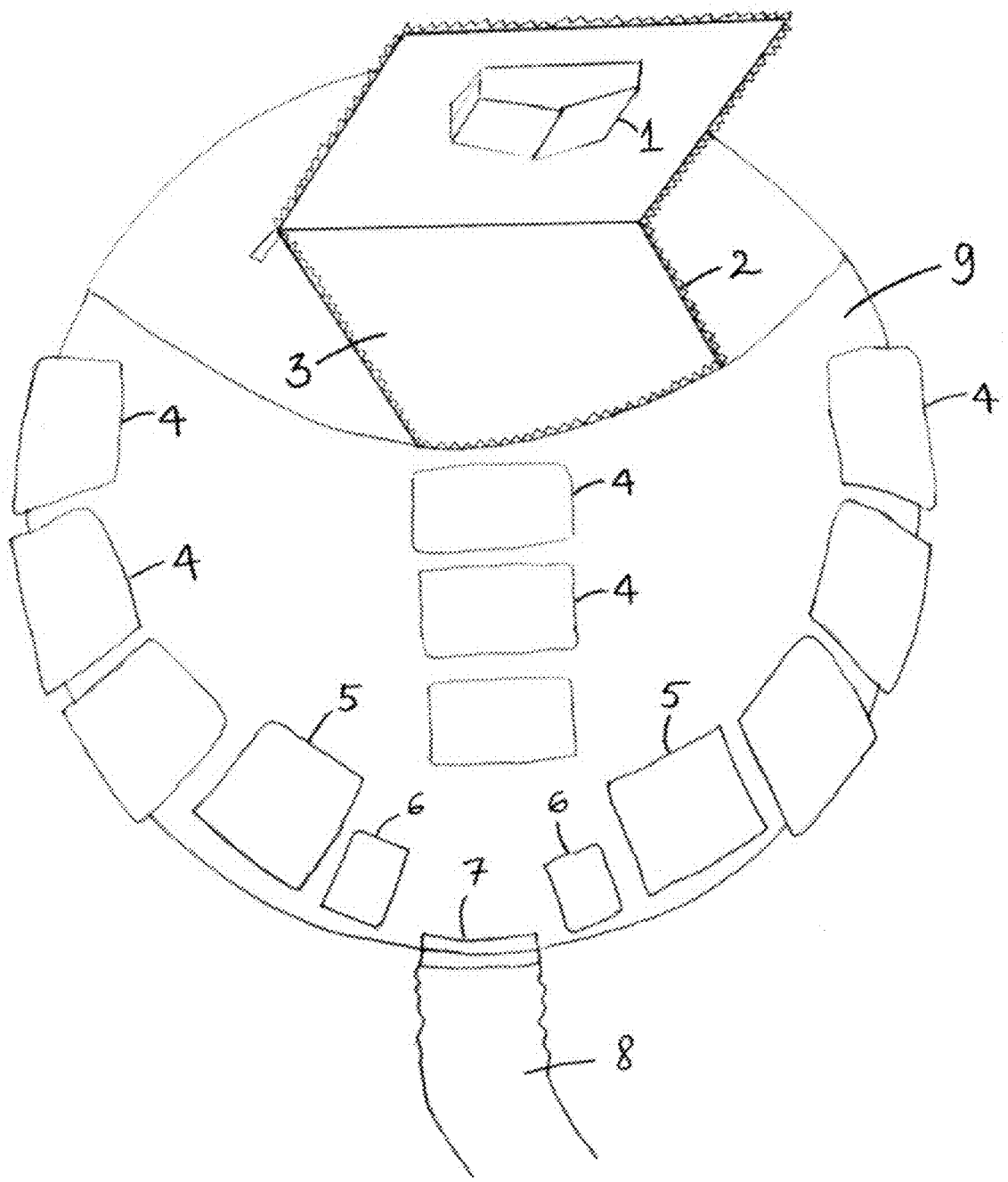
FIG. 6 is a diagram of a front view of the washer ball.
Figure 7:
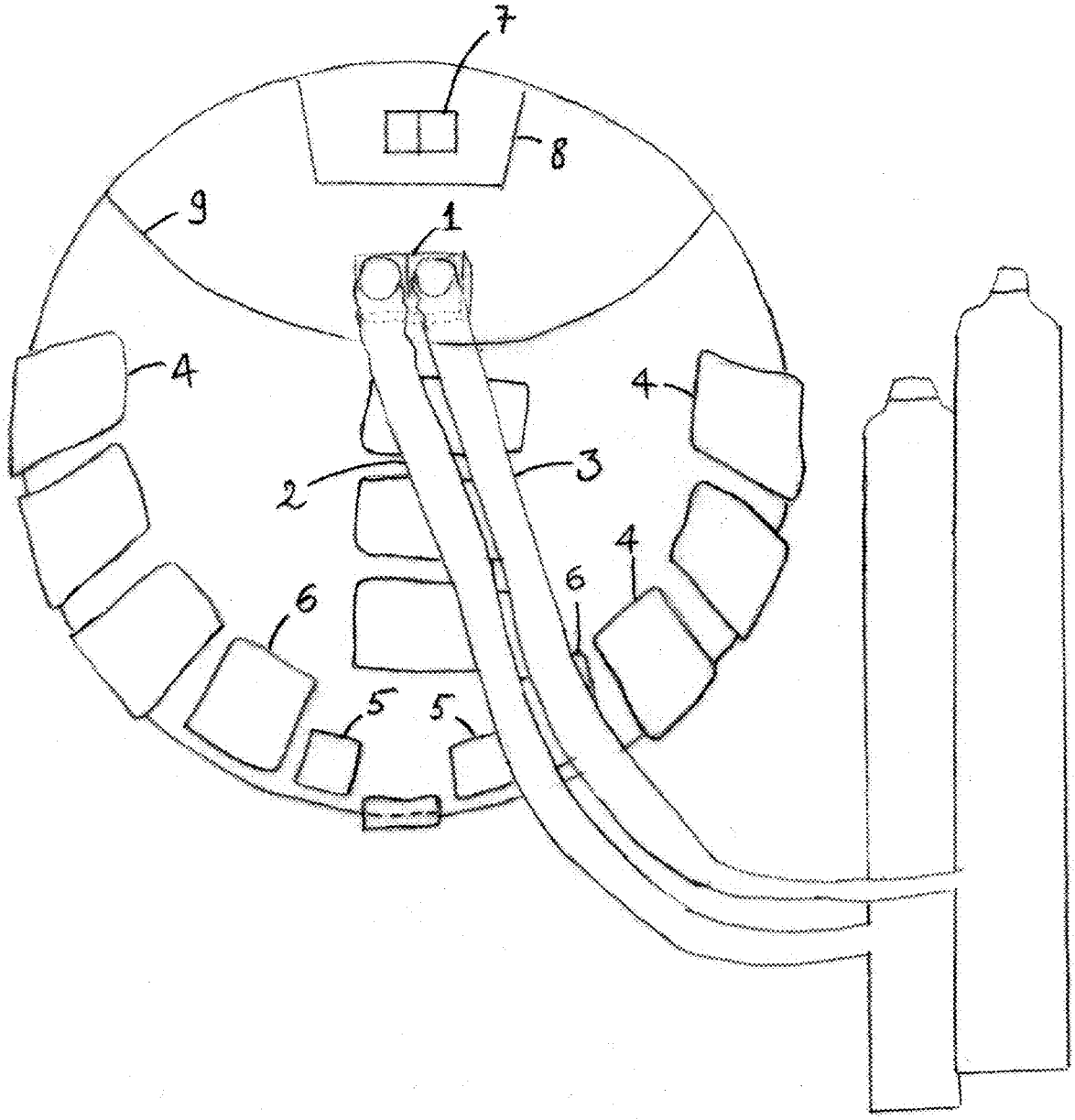
FIG. 7 is a diagram of a back view of the washer ball.

The two solenoid valves are diposed on the back view of the washer ball just below the lid. Each valve is about one and a half (1.5) inches in diameter, for hot and cold water poured into the ball in a timely manner, that hooks to hot and cold water hoses to the reservoir tanks from the outside. (FIG. 5, 7, 10*a*, 10*b*)

The detergent and additive agents are delivered intermittently, two (2) minutes apart for a total two times (four robot hands cycles), into the ball via an automated delivery slanted sliding door controlled by a solenoid electric-mechanical linear actuator.

Figure 11A:
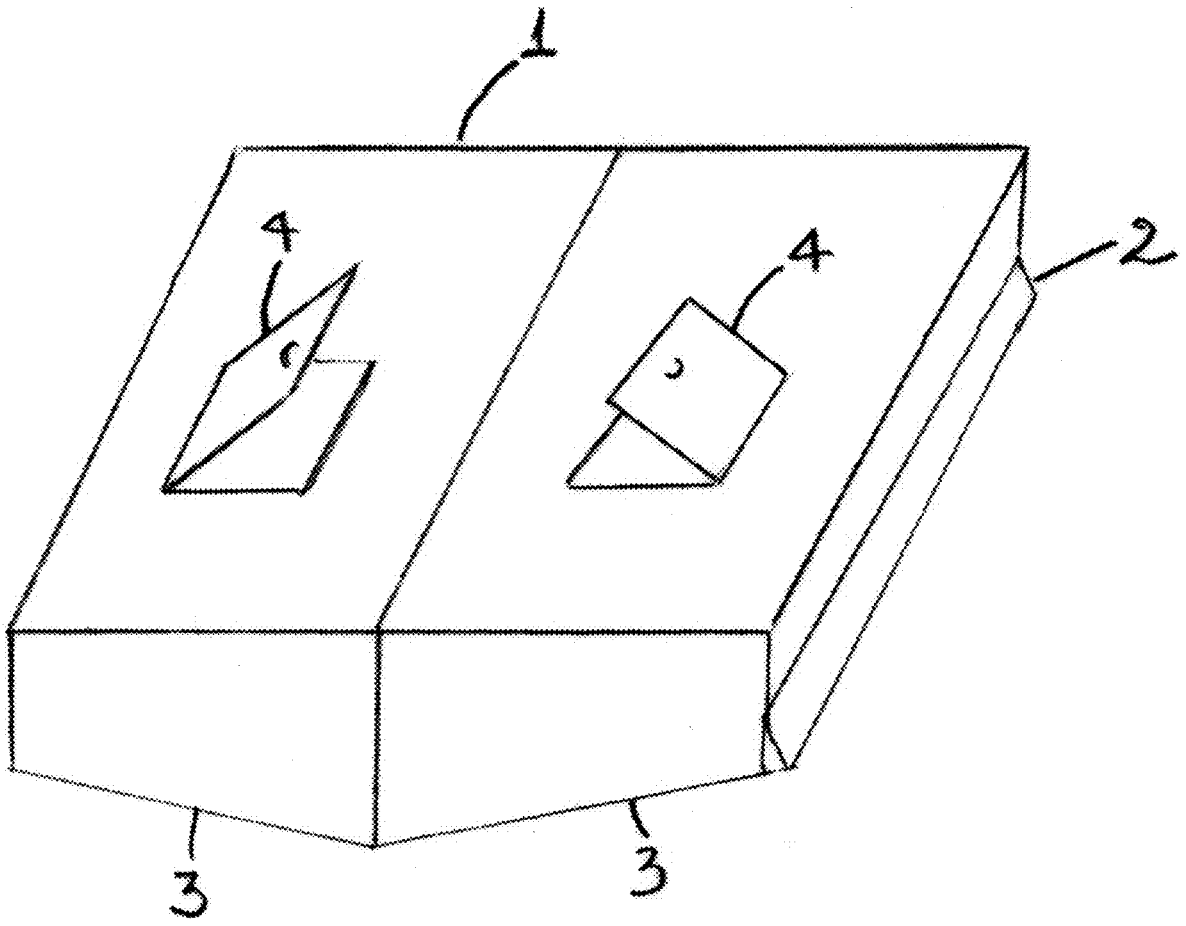
FIG. 11A is a diagram of the detergent and additive supply box when both loading doors are open.
Figure 11B:
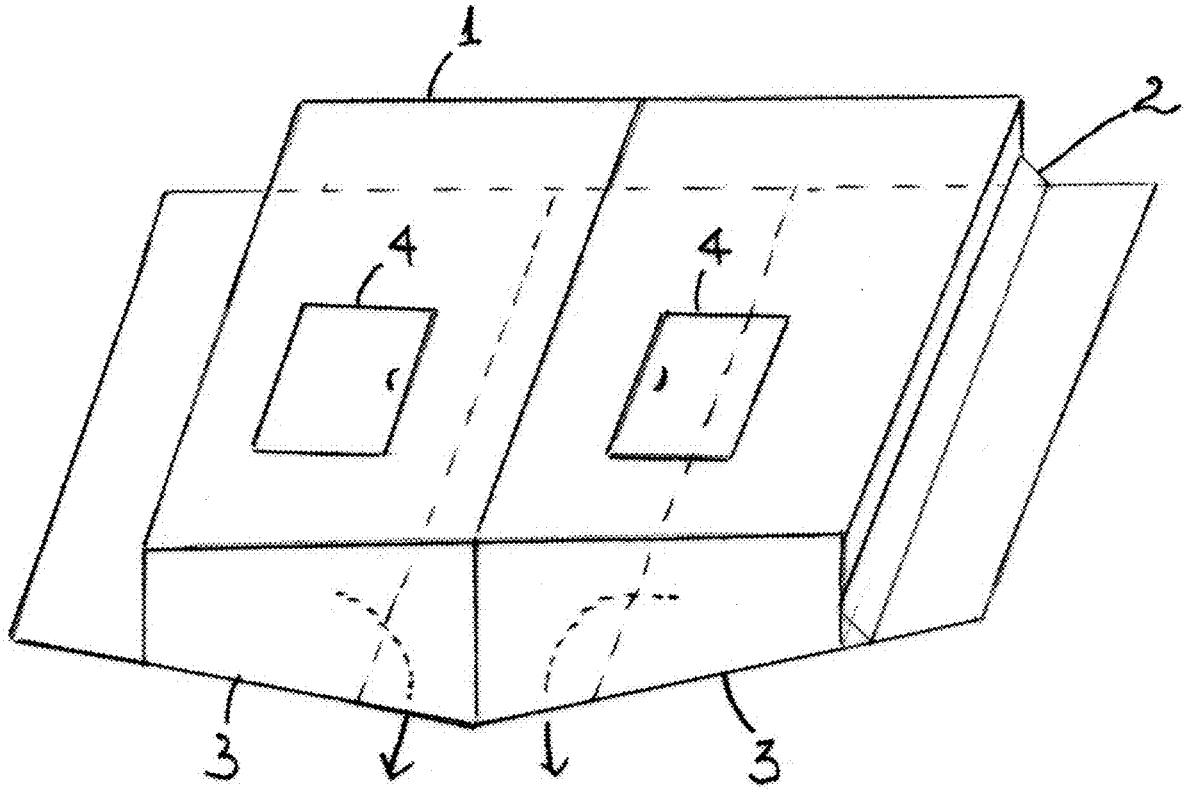
FIG. 11B is a diagram of the detergent and additive supply box when both loading doors are closed.

The two intermittent deliveries of detergent and additives with two minutes apart are to guarantee the washer ball has enough time to mix the clothes and fabric items with the detergent and fluid equally and slowly until they are all spread out evenly concentrated in the water and clothes in the ball so that the wash becomes more efficient and does not affect one area more intensely than another area at a specific time. (FIG. 11*a*, 11*b*)

Movements generated by the robot hands change the shape of the ball. The ball transfers the motion effects of pulls and pushes like hand washing movements onto the clothes and/or other fabric items inside to extract dirt, soil, stain, etc. Movements are generated alternatively by pairs of robot hands on walls and floor at different positions as described in the operation and use section. (FIG. 1, 3, 4)

Although, the maximum volume of the washer ball can retain up to 26.6 gallons—calculation shown above), water should only be filled to a maximum of half (½) of the ball. In fact, the maximum volume in reality for each wash mode or rinse mode is up to seven (7) gallons. This is to guarantee the integrity pre-programmed computerized actions of washes, rinses, and drains for any successful mode. The ball can sustain the pressures created in pulls and pushes of mechanical movements.

An average load of any average washer currently on the market engulfs about 20 gallons of water divided into the wash mode and at least two rinse modes. This washer engulfs, for a bigger load, from 15 to 19 gallons, the biggest load allowed is 20 gallons. This is still within the tankage of the washer ball (26.6 gallons). However, again, in a specific mode, the real volume of the contents (clothes, water) is about seven (7) gallons plus clothes. This is less than one third of 26.6 gallons. This guarantees the integrity of the ball under pressures of robot hands movements.

Sensors and valves are made into as small a size as possible without affecting their accuracy by the movements. Most of the valves and sensors are made of plastics, the kind of light, strong, flexible, yet little stretchy types.

Outer layer on the outside of the ball are many large square strong velcro, a square with one side of about four (4) inches, at corresponding positions to the velcro on the robot hands that are planned to attach onto them. The robot hands velcro are screwed or glued onto plastic plates that conform to the shape of the ball locations where they are supposed to attach onto. The ball is hung at the center of the machine shell by these strong industrial velcro attachments. (FIGS. 1, 3, 4, 6, 7, 8 and 12)

Robot hands on the walls include three pairs of robot hands on the two opposite walls to make totally twelve robot hands by six pairs for all four walls. (FIGS. 1, 2, 3, 4, and 16)

Description of One Robot Hand and how it Creates Movements:

As stated earlier, the measurements for the components of robot hands, balls, and other auxiliary structures below are only initial estimations so these numbers of measurements are subjected to be adjusted and monitored when they are essentially needed to do so for manufacturing the properly functional SHW Washer machine.

A fifteen-inch (15) zigzag shape robot hand is made up of strong yet light metal (inox, aluminum, steel, etc.), composed of two lines of five (5) 3-inch length, 0.08 inch in thickness, and 0.5 inch in width strut rods folded into zigzag shape "mirroring" at each other as the belt sits right at the mid-line attached to them. These rods can extend and retract at times due to the belt sliding back and forth onto the chain that hangs onto the wheels like the structure of a bike. The movements of the individual rods in concert with the other rods would make the whole robot hand move with push and pull motions. The robot hands are covered with clear plastics on the outside while they are in direct contact with the belt from the inside. (FIGS. 1, 2, 3, and 4)

The belt is made by metal (inox, aluminum, steel, etc.) into a strong and thin strip about a quarter of an inch (0.25) width, fifteen (15) inches in length, and about 0.08 inch in thickness that can directly hold (at the middle of) the two zigzag-shaped robot hand rods to push them back and forth as the creation of motions for these robot hands. This belt is of the same structure for wall and floor robot hands. (FIG. 1, 2, 3, 4)

One end of this robot hand, the last 3-inch rod is screwed by a plastic screw onto a plastic dome shape plate, about four inches on each side, conformed to the dome shape part of the ball that it is supposed to attach onto. This plastic dome-shape plate is, in turn, glued or screwed onto a dome-shaped industrial velcro piece that, in turn, attaches to the velcro position on the washer ball. (FIGS. 1, 2, 3, 4, 6, 7, and 8)

From a reliable source about velcro strength, a two-square-inch piece of an industrial velcro can support and hold an item of (100) one hundred pounds. Accordingly, the total sixteen velcro of sixteen robot hands on walls and floor, that can hold up to 100*16=1600 pounds, would be well able to hang firmly the washer ball at the center of the machine shell with this strength whether or not the ball is full of water, load of clothes, and fabric items in wash mode or empty. (source: https://www.quora.com/What-are-the-properties-of-velcro) (source: http://sciencing.com/velcro-6470547.html)

The belt can slide back and forth on the chain-wheel structure since it is hooked onto the electro-mechanical linear solenoid actuator that can initiate the chain-wheel movements so to create straight-line extend and retract movements of the robot hands in a timely manner. (FIG. 1, 2, 3, 4)

The longest extension length is fifteen (15) inches; the shortest retraction length is three (3) inches; the number is a multiplication from five 3-inch rods that make up of the full extended length of the zigzag robot hands.

There are four (4) electric-mechanical linear actuators as described above for the four side walls and two for the floor robot hands. (FIGS. 2*a* and 2*c*) Each wall actuator controls three robot hands on its wall while each floor actuator controls two robot hands attached to it. (FIGS. 1, 2, 3, and 4)

The power created by these linear actuators is called mechanical power out:

$$Po=(F*v)$$

Calculating minimum power output to transmit onto the load is described below. This is the average power needed to lift the maximum load allowed for the ball from the maximum folded zigzag position point, as point A to maximum extended position point, as point B, is about 15 inches (5 rods of one robot hand, each rod is 3 inches long) or 0.381 m in 1 second:

$$Po=F\times v=(F\times S)/t$$

Where P=power (W); F=force (N); S=linear distance (m); and t=time (sec.) v: velocity (m/seconds)

When we know the force created by one robot hand, we would be able to calculate the power out for each pull and push. But, it is low energy consumption as a quality and educational guess from the structure, the size, and the type of short linear motions of a robot hand.

(Source: http://www.machinedesign.com/motorsdrives/how-pick-motors-linear-motion) given the example:

$$P=\frac{F\times S}{t}=\frac{88\ \text{N}\times 0.2\ \text{m}}{1.0\ \text{sec}}=17.64\ \text{W}$$

() Robot hands at the bottom of the machine: four robot hands at the floor of the machine make an imaginary square surrounding the drainer at the center and the two scales on either side of the drainer valve and outlet hose. (FIG. 2***c*)

The components made up of the floor robot hands are similar to the wall robot hands. However, the floor robot hand belts oscillate up and down vertically (instead of horizontally for the wall robot hand belts) so that they will push and pull the floor robot hands vertically up and down instead of horizontally as the wall robot hands do.

Figure 2A:
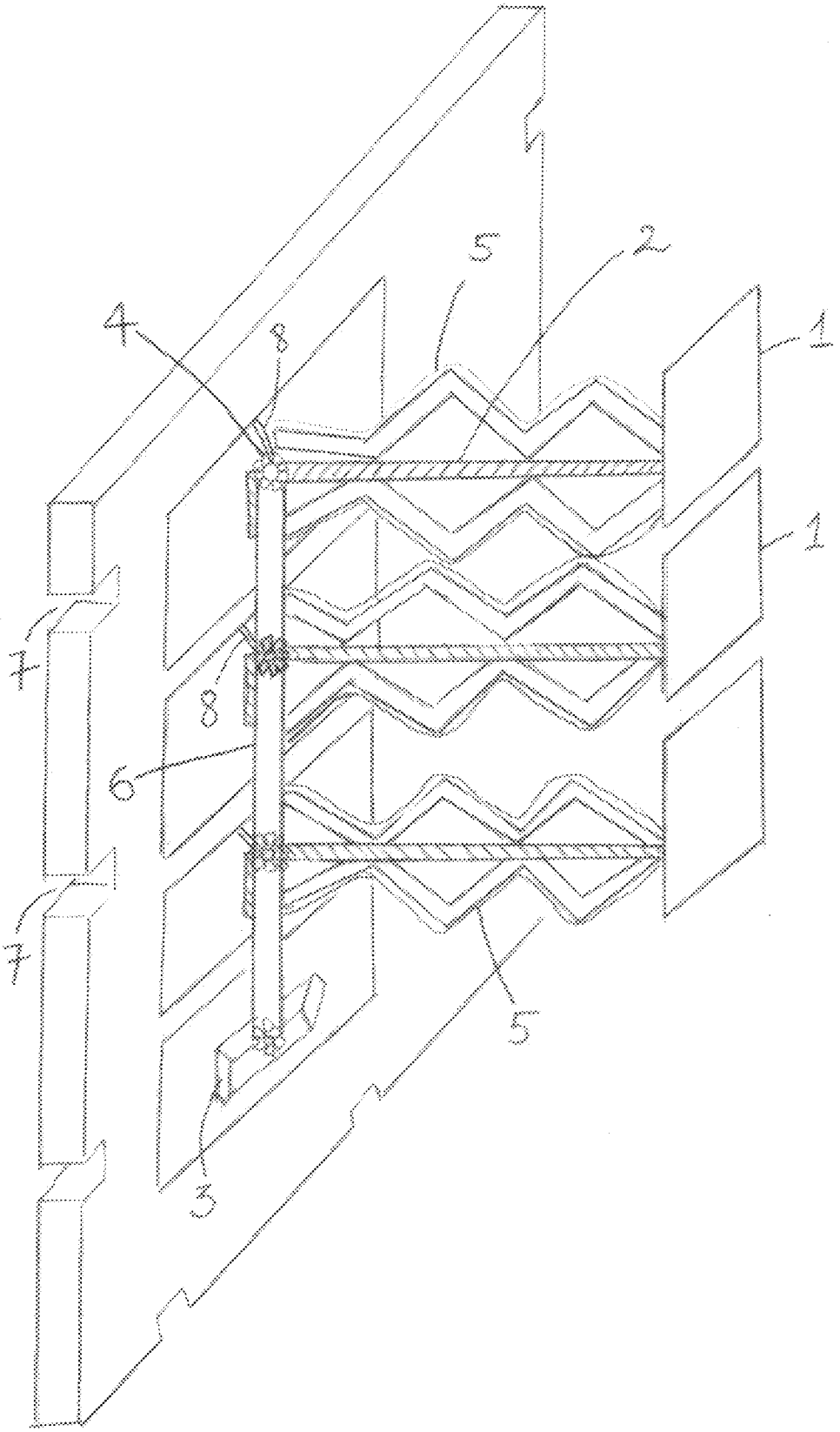
FIG. 2A is a diagram of a perspective view of linear solenoid actuators for wall robot hands.
Figure 2B:
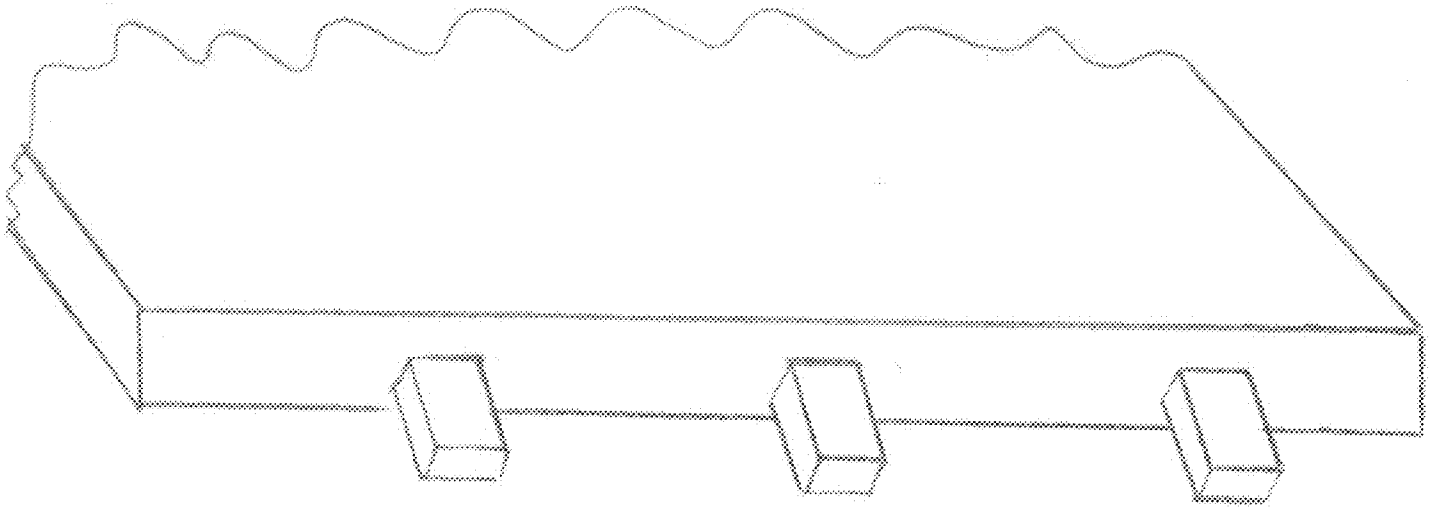
FIG. 2B is a diagram of a perspective view of a wall of the SHW washer shell.
Figure 2C:
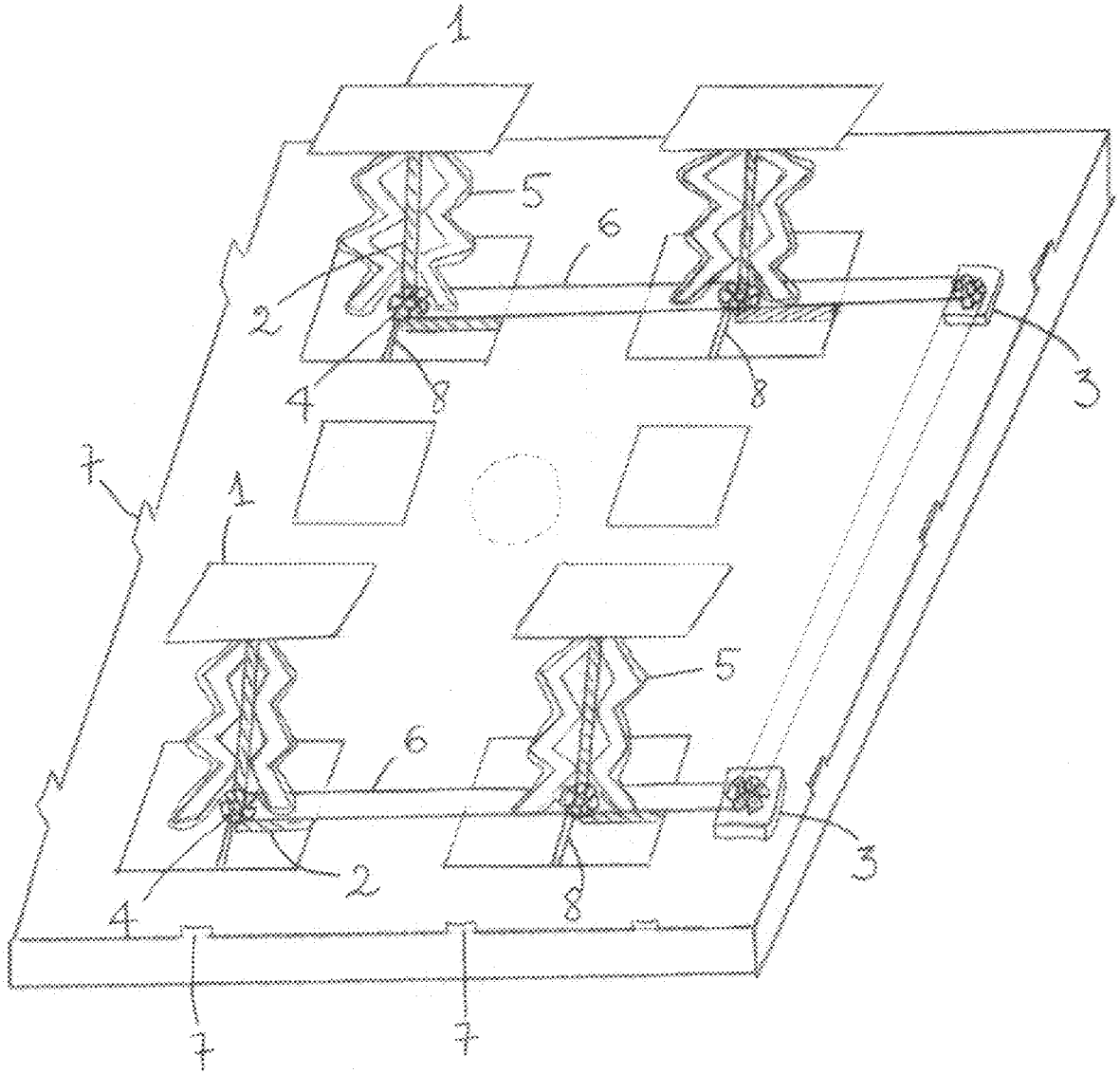
FIG. 2C is a diagram of a perspective view of linear solenoid actuators for floor robot hands.
Figure 2D:
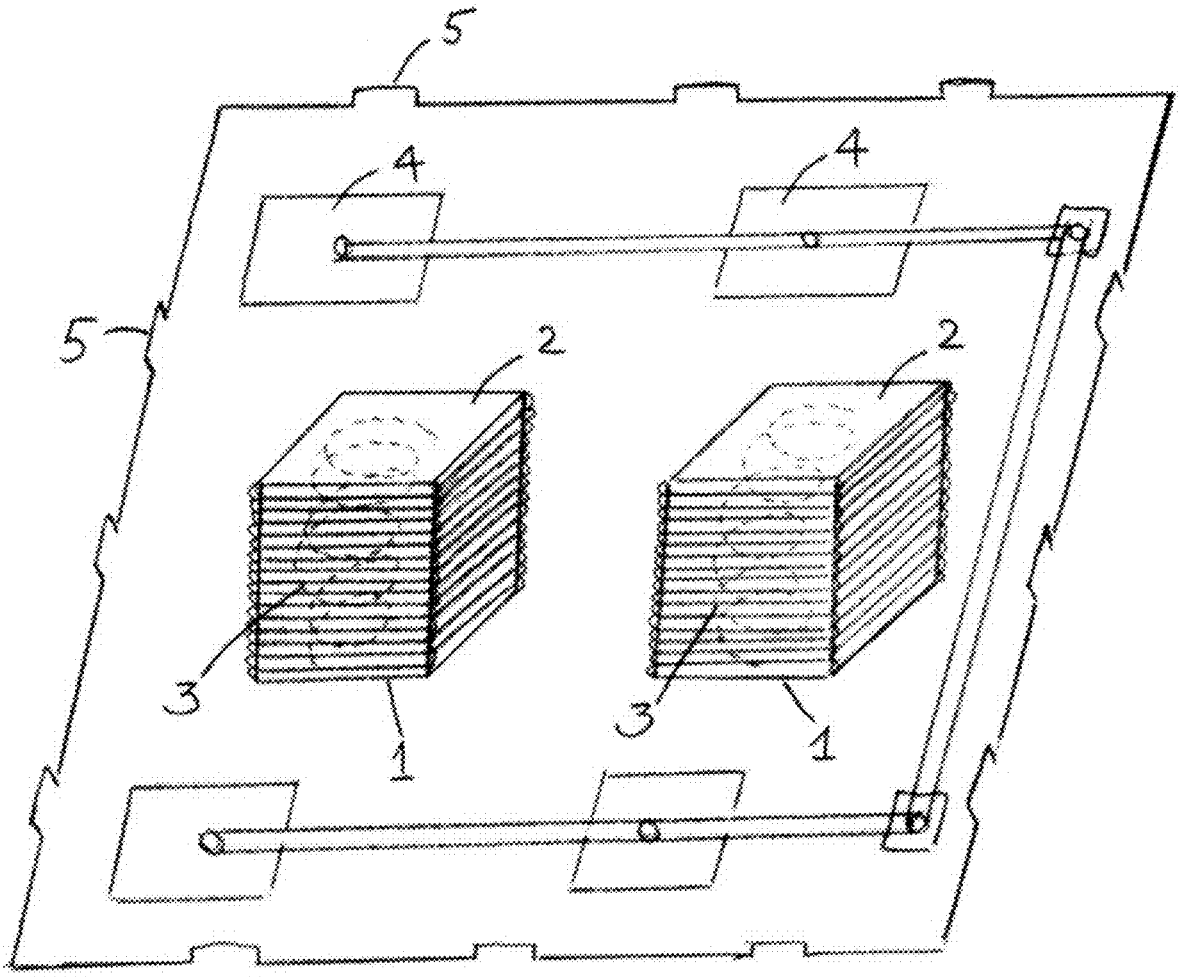
FIG. 2D is a diagram of a perspective view of the scales and positions of the floor robot hands as of FIG. 2C.

The other difference each linear electric-mechanical actuator on the floor control two floor robot hands while one actuator on the wall controls all three robot hands on its wall. (FIG. 2*a*, 2*c*).

The two floor actuators are connected so that they can simultaneously initiate the movements of all four floor robot hands at the same time to summate the power to raise the ball. (FIG. 2*c*)

With regard to the consumption of energy described above, the machine can also be alternatively reduced proportionately in size, number of robot hands, the linear actuators, and other features that give possibly a smaller version of a SHW washer as compared with its original size. For example, we can reduce from three to two robot hands on each wall, three robot hands on floor, instead of four with only one linear actuator instead of two for controlling all three floor robot hands. The sizes and measurements can also be adjusted. In other words, the original machine can be made into a new smaller accustomed version. This can even further save energy, water, environmental friendly, and other beneficial features.

As described above, the shell is made into six pieces: four walls, one floor and one lid. They all have female and male joints and hinges for the lid to attach to the wall so that users can assemble and disassemble by themselves easily. (FIG. 2, 12)

Figure 12:
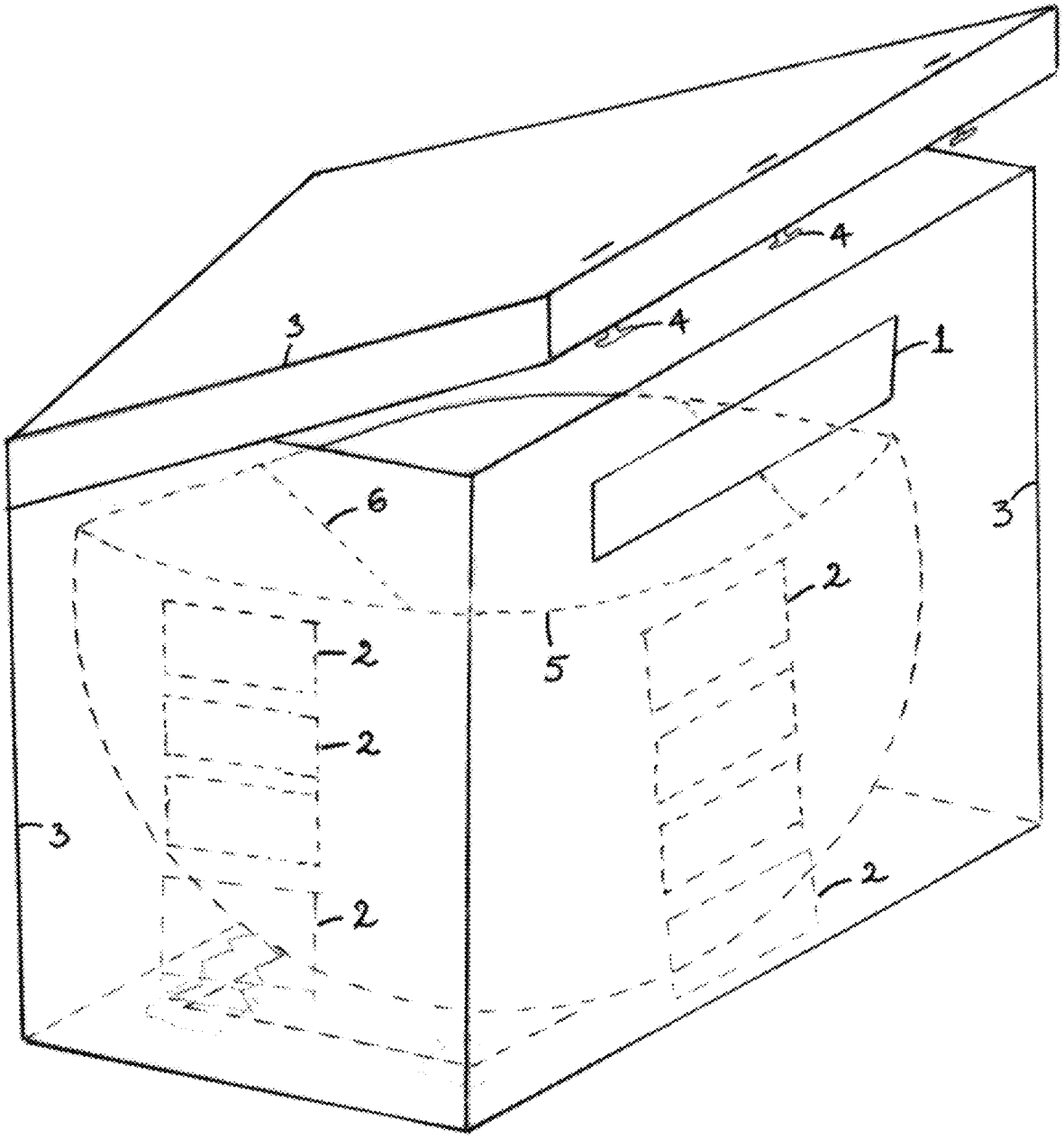
FIG. 12 is a diagram of a perspective view of the simulated hand-wash washing machine within its shell.

The shell is about thirty five (35) inches on each side including the lid to make up a square cube machine. (FIG. 12)

The control panel is at the front view as on the upper part of the front wall of the shell. It should be located at the height of about twenty-five to thirty (25-30) inches so that all users (adults and adolescents) either short or tall statutes can still reach the control panel. (FIG. 12, 15)

The control panel will provide information about the weight sensor that read the load weight and gives warning if a load is overweight. The control panel contains all the wash modes, volume of water, hot/cold water, and extra choices as discussed above. The control panel also provides information of the operation is on duty, which phase it is at and how long the phase is working and time left for finishing the phase as part of the whole wash mode. There are also ways to pause while the machine is just starting for a few minutes. However, interruptions should be minimized while the machine is already running for a while. After 15 minutes running, the machine cannot be paused. It can be stopped altogether though. At the end of the wash mode, the control panel will give some musical sounds as the notice to users to take clean clothes out for drying. (FIG. 12, 15)

Figure 13:
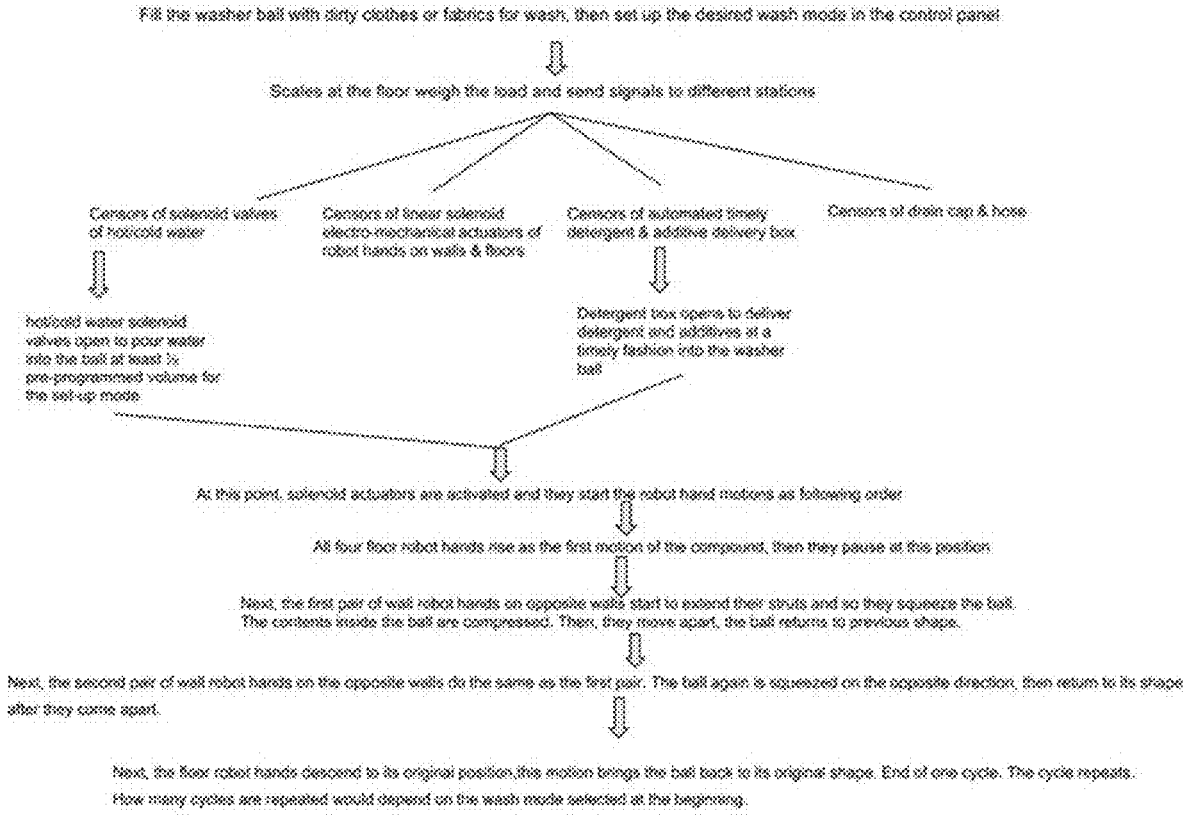
FIG. 13 is a flowchart of a method in accordance with one novel aspect.

Operation and Use:

A—Operation of Washing Mode: FIG. 13

1—Load the dirty clothes, load detergent, and additives (e.g. oxyclean)

2—Set up the control panel for desired washing mode. There are six (6) major modes: heavy duty, normal wash, gentle wash, delicate wash, rinse only, and ball cleaning. User can also pick hot, warm, or cold water for their wash modes. There are also minor choices added into the major wash modes, e.g. "extra water" choice, "extra rinse" choice, and "delay wash" choice.

3—Close the loading door zipper.

5—Turn on the "RUN" status.

After the machine is turned into "RUN" status, the control panel will send eccentric signals to centers of sensors. Next, signals to different stations of the compound are released; they include: the robot hand electro-mechanical linear solenoid actuators (both side walls and floor), the hot/cold water solenoid valves, the detergent and additive solenoid automated releasing box, and the drain station sensors. Each of these stations has their own sensors. Solenoid valves are used.

6—The two scales at the bottom weigh the load and determine the size of the load and the correspondent volume of water: Normal load: 9 to 10 pounds; heavy load: 11-15 pounds; overload: >15 pounds.

7—The hot and cold water solenoid valve sensors receive signals from the control panel about the weight of the load, the wash mode setup and determine the volume of hot, warm, or cold water ready to pour into the ball. The water valves are then opened to pour water into the ball.

The following is the loads and their correspondent volume of water:

| Load | water used for wash | water used for 1st rinse | water used for 2nd rinse | total | Extra water to 1 rinse |
|---|---|---|---|---|---|
| <9 lbs | 4 gallons | 4 gal | 4 gal | 12 gal | 2 gal |
| 9-10 lbs | 5 gallons | 5 gal | 5 gal | 15 gal | 3 gal |
| 10-14 lbs | 6 gallons | 6 gal | 7 gal | 19 gal | 4 gal |
| >15 lbs | 6 gallons | 6 gal | 7 gal | 19 gal | 4 gal |

8—Detergent, bleach, and additives:

1 average load: Detergent would be put into one box while all additives are put into the other box 1 standard cup of HE all-machine detergent, 1 cup of color bleach/white bleach (optional)

1 cup of oxyclean. (optional)

1 large load: 2 cups each

Softener can also be added.

Figure 3:
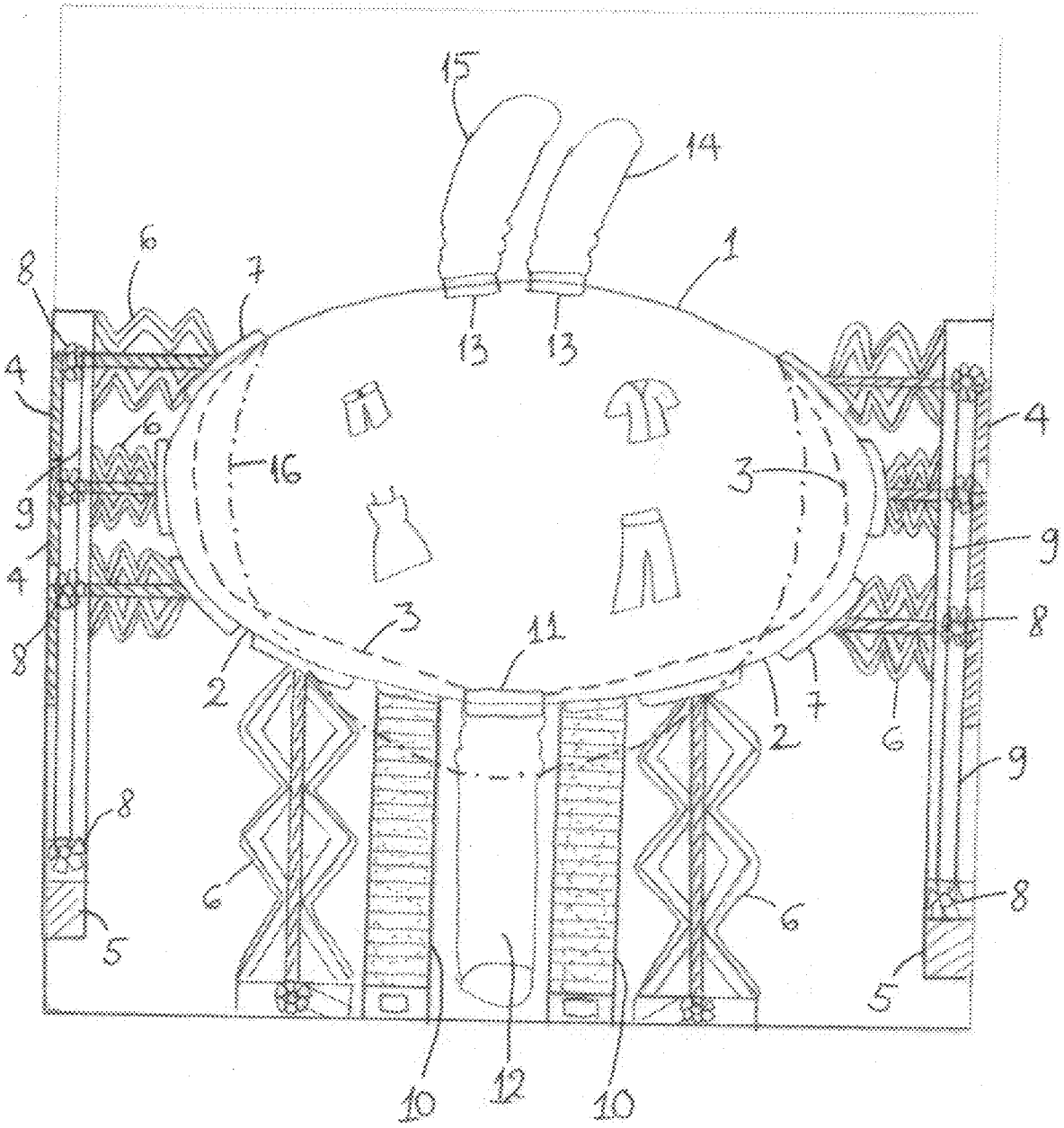
FIG. 3 is a diagram of floor robot hands causing a washer ball to change into a configuration.

9—Although all the actuators receive signals, the floor robot hand actuators are activated first. They start to rise up and to push the ball upward perpendicularly. Next, the wall robot hands on opposite side start to push perpendicularly forward horizontally then pull backward horizontally. Next comes the turn of the other pair of opposite wall robot hands to do the same thing. (FIG. 3, 4, 16)

The length of travel of robot hands is determined by the wash mode selected. For example, if heavy wash, robot hand travel the full length of the belt (about 15 inches: each robot hand has 5 rods put into zigzag shape; each rod is 3 inches in length). If normal wash, robot hands travel four-fifths (4/5) of the full length; if gentle wash, robot hands travel three-quarters (3/4) of the full length, and if delicate wash, robot hands travel half length (1/2).

At the end of all and any wash mode, all robot hands (walls and floor) always push forward maximally, which mean they travel the maximal distant of 15 inches so that they can squeeze out all the water from the inner net layer into the outer layer.

The order of robot hands movements to create mechanical movements: explanation of FIG. 16:

9*a*—First of all, the bottom robot hand starts to push up the ball bottom so the load of dirty clothes inside is raised.

9*b*—The robot hands on the side wall have alternate motions in opposite direction to one another. See illustration below: as one cycle of wash or rinse motions: we have four walls of the machine shell as a, b, c, and d:

9*c*—After all two pairs of wall robot hands push, pull, and return to their original positions the floor robot hands would lower the ball half the way.

9*d*—The cycle repeats and continues for the full wash mode. Each cycle, counting from floor robot hands push up until the second pair of wall robot hands return to their original position, which takes about one (1) minute to complete.

9*e*—As explained above, after all the cycles for a specific wash mode are complete, all the robot hands would travel the maximum distance of 15 inches to summate the strongest power to squeeze out all the water. The water is drained from the inner net layer into the outer layer ready for drain.

9*f*—Cycles of wash modes:

Heavy wash: total 120 cycles divided into 50 cycles for wash, 35 for first rinse, and 35 for second rinse. Total is 120 minutes.

Normal wash: total 110 cycles divided into 50 cycles for wash, 30 cycles for first rinse, and 30 cycles for second rinse. Total is 110 minutes.

Gentle wash: total 90 cycles divided into 30 for wash, 30 for first rinse, and 30 for second rinse. Total is 90 minutes.

Delicate wash: total 80 cycles divided into 20 for wash, 30 for first rinse, and 30 for second rinse. Total is 80 minutes.

Extra wash: add 30 cycles divided into 15 for wash, 15 for first rinse. Total is 30 minutes added.

Extra Squeeze mode: wall and floor robot hands travel maximum distant of 15 inches to squeeze out all water.

Rinse only: 30 cycles for each rinse

Delayed wash: just water and detergent with four cycles of robot hands for mixing the detergent, wait for 30 minutes soaking the clothes. Then, the robot hands start their cycles.

Ball cleaning: 15 cycles of wash, 10 cycles of first rinse, 10 cycles of second rinse.

Figure 15:
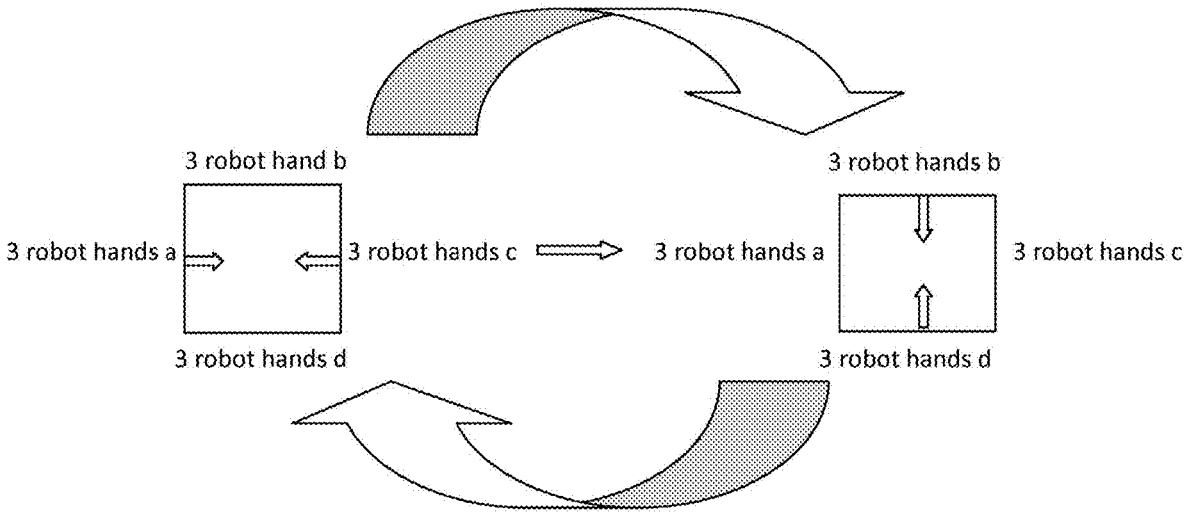
FIG. 15 is a diagram that shows the cycles of robot hands.

FIG. 15 shows the cycles of robot hands. There are three pairs of wall robot hands. Wall "a" is opposite wall "c". Wall "b" is opposite wall "d". The pair of opposite walls of robot hands "a" and "c" push toward each other while the pair "b" and "d" stand still. After the pair "a" and "c" finish their push, then the pair "b" and "d" perform their push.

10—After the washing cycles with detergent are finished, the solenoid sensors from robot hand mechanical station send signals to the control panel. The control panel then sends signals to the drainage solenoid valve sensor to push open the drain cap for dirty water to be drained out.

When the water flow through the drain stops, the drain cap is shut. This event triggers the drain sensor to send signals to the control panel. The control panel sends signals to the clean hot/cold water solenoid valve sensors to pour clean water in for the first rinse. Then, the water valve sensor also sends signals to the control panel, and the control panel sends back signals to the robot hands mechanics station to start the movement cycles again for first rinse. The movement cycles repeat the order in the same way as in wash mode: first floor robot hands to raise the ball, next two opposite wall robot hands a & c push and pull, then next is the other two opposite robot hands b & d. (FIGS. 13, 14, and 16)

11—The same order of work is repeated for the second rinse.

3—The water flows through the small square holes (of a quarter of an inch (0.25) on each side) of the inner layer net of the ball and goes down the drain by gravity. When the last drop of water is drained, the drain cap valve is shut.

14—The number of cycles for each period of wash and rinse listed in item 9*f*.

15—If the rinse mode alone was selected from the beginning, the center of sensors sends signals for only the pathway of these modes operate while shut down the other actions. (FIG. 14)

16—At the end of the second rinse, all the sensor stations finish, and clean clothes are ready to take out for drying.

B—Operation Rinse Mode Only or Washing Ball Mode:

The rinse mode alone is similar to the rinse phase and drain phase in the wash mode. The difference is the cycle of robot hands just do the phase of rinsing and there is no involvement of regular wash mode repetitive cycles, but instead only the rinse mode. (FIG. 14)

NOTES OF DRAWINGS

FIG. 1—The SHW Washer: cross sectional operation (Simulated Hand-wash washer):

1. Lid
2. Washer ball—outer layer
3. Washer ball—inner & lower part layer
4. Belts for one of sixteen robot hands
5. Linear solenoid actuators: one of six linear solenoid actuators on walls and floors (electric-mechanical boxes)
6—Robot hands with plastic cover
7, 8, 16: strong industrial velcro with dome-shaped plastic plate.
9. Wheel
10. Wheel chain
11. Scale
12. Solenoid drain valve
13. Drain hose
14. Hot/Cold water solenoid valves
15. Hot/Cold water hoses FIG. 2—The Elements of movement:
FIG. 2*a*—Linear solenoid actuators for wall robot hands
FIG. 2*b*—Linear solenoid actuators for floor robot hands
1. Strong industrial velcro with dome-shaped plastic plate
2. Belt
3. Linear solenoid actuator electric-mechanical box
4. Wheel
5. Robot Hands with plastic cover
6. Chain FIG. 2*c*—scale
1. Box to read the weight of the load (subtracting washer ball weight)
2. Container (resilient metal or plastic) with velcro on top to attach to ball
3. Spring FIG. 3—an example of configuration changes of the washer ball by floor robot hands
Same notes as FIG. 1

Figure 4:
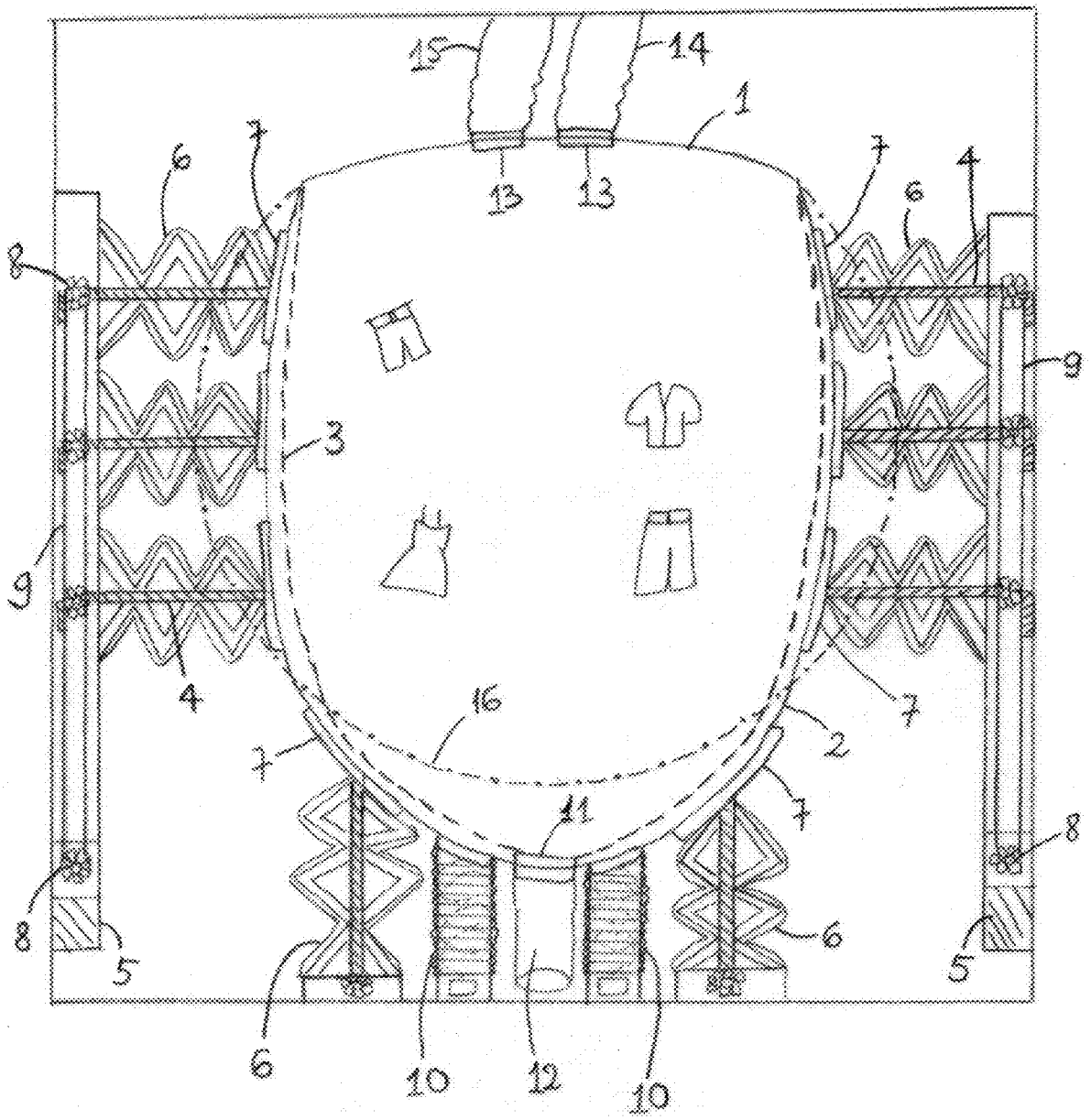
FIG. 4 is a diagram of wall robot hands causing the washer ball to change into another configuration.

FIG. 4—an example of configuration changes of the washer ball by wall robot hands
Same notes as FIG. 1

Figure 9A:
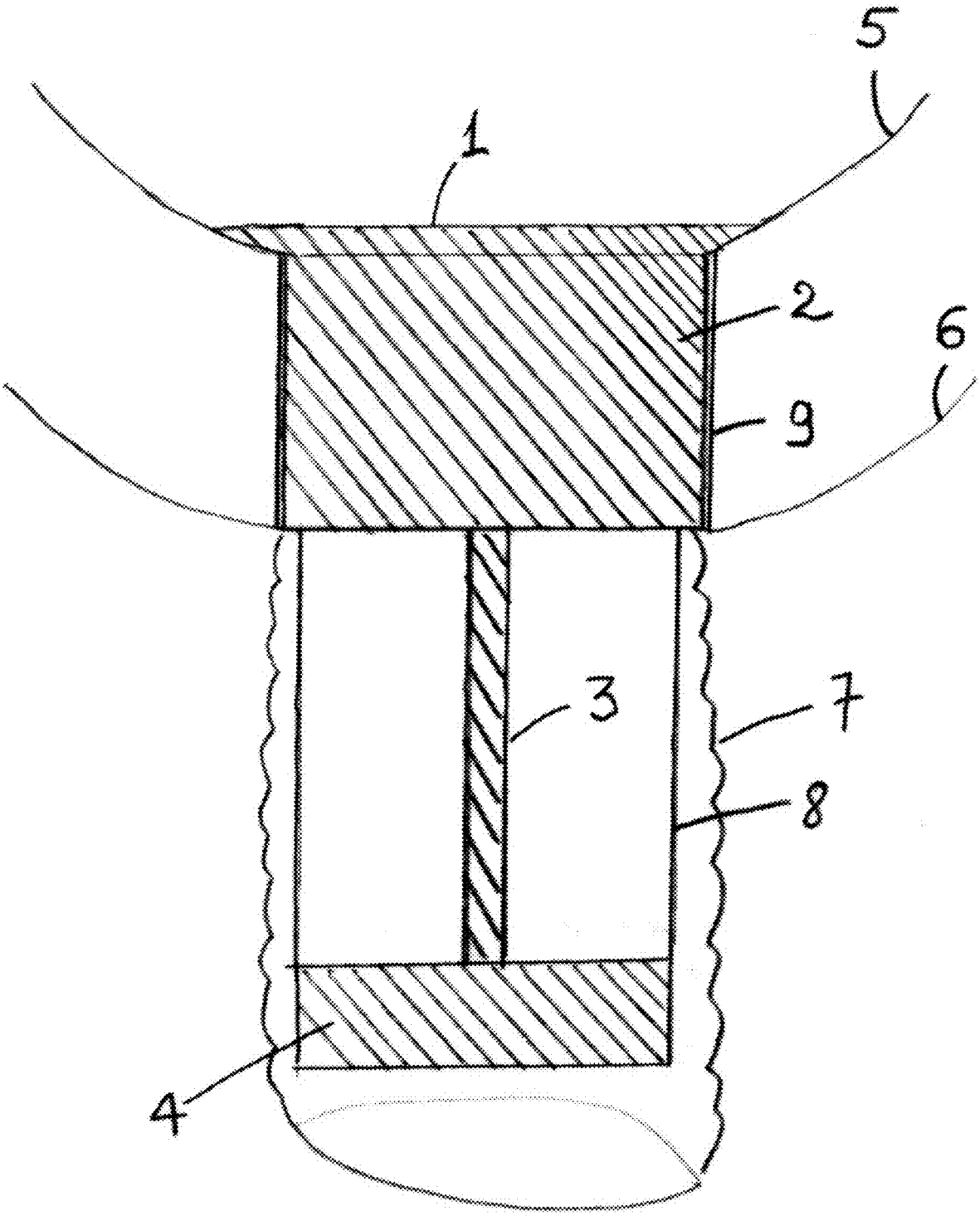
FIG. 9A is a diagram of a solenoid drain valve when in a closed state.
Figure 9B:
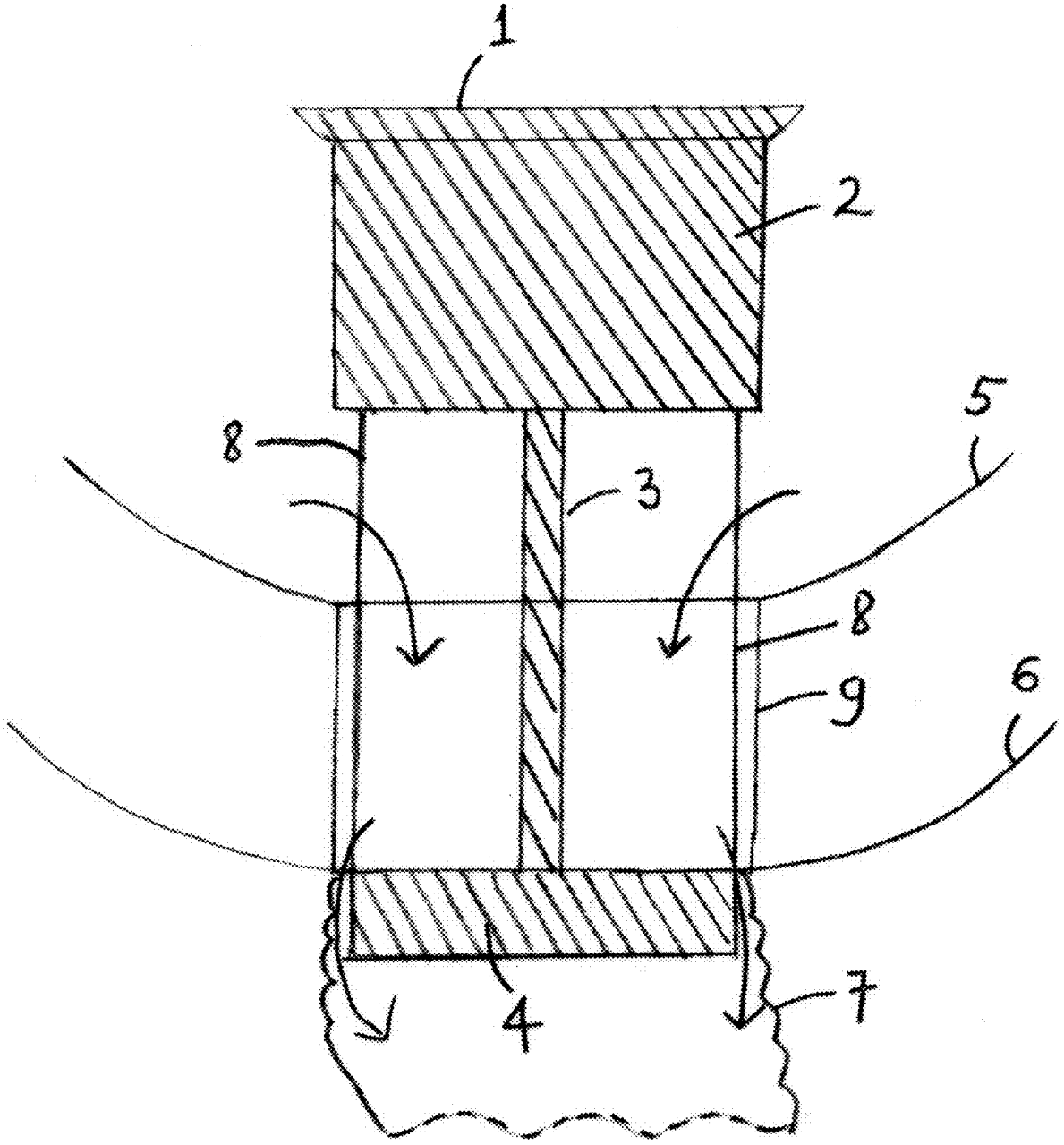
FIG. 9B is a diagram of the solenoid drain valve when in an open state.

FIG. 5—Washer ball lid
1. Hot/Cold water solenoid valve control box
2. Hot/Cold water valves (hoses are attached above lid)
3. Washer ball loading door (for clothes loading) and its zipper
4. Detergent and additive solenoid automated releasing box with slanted automated doors.
5. Washer ball lid FIG. 6—washer ball outer look, front view
1. Detergent and additive solenoid automated releasing box with slanted automated doors.
2. Zipper for closing and opening loading lid
3. Loading door
4. Velcro to attach the washer ball to wall robot hands with dome-shaped plastic plate.
5. Velcro to attach the washer ball to floor robot hands with dome-shaped plastic plate.
6. Velcro to attach the washer ball to floor scales with dome-shaped plastic plate.
7. Solenoid drain valve
8. Drain hose
9. Washer ball front view FIG. 7—washer ball outer look, back view
1. Hot/cold water solenoid valves
2. & 3. Hot/cold water hoses
4. Velcro for attaching the washer ball onto wall robot hands with dome-shaped plastic plate.
5. Velcro for attaching the washer ball onto floor scales with dome-shaped plastic plate.
6. Velcro for attaching the washer ball onto floor robot hands with dome-shaped plastic plate.
7. Solenoid automated detergent releasing box
8. Loading door
9. Washer ball lid FIG. 8—washer ball inner look
1. Inner net layer of lower part of washer ball
2. Outer layer of lower part of washer ball
3. Cap of solenoid drain valve
4. Velcro to attach washer ball to wall robot hands with dome-shaped plastic plate.
5. Velcro to attach washer ball to floor robot hands with dome-shaped plastic plate.
6. Velcro to attach washer ball to scales at floor with dome-shaped plastic plate.
7. Drain hose
8. Solenoid drain valve FIG. 9—Solenoid drain valve
FIG. 9*a*: shut/close phase
FIG. 9*b*: open/drain phase
1. Drain cap
2. Drain plug
3. Drain plug leg
4. Solenoid linear actuator
5. Inner layer (net structure) of washer ball
6. Outer layer of washer ball
7. Drain hose
8. Valve frame
9. Washer ball drain hole.

Figure 10A:
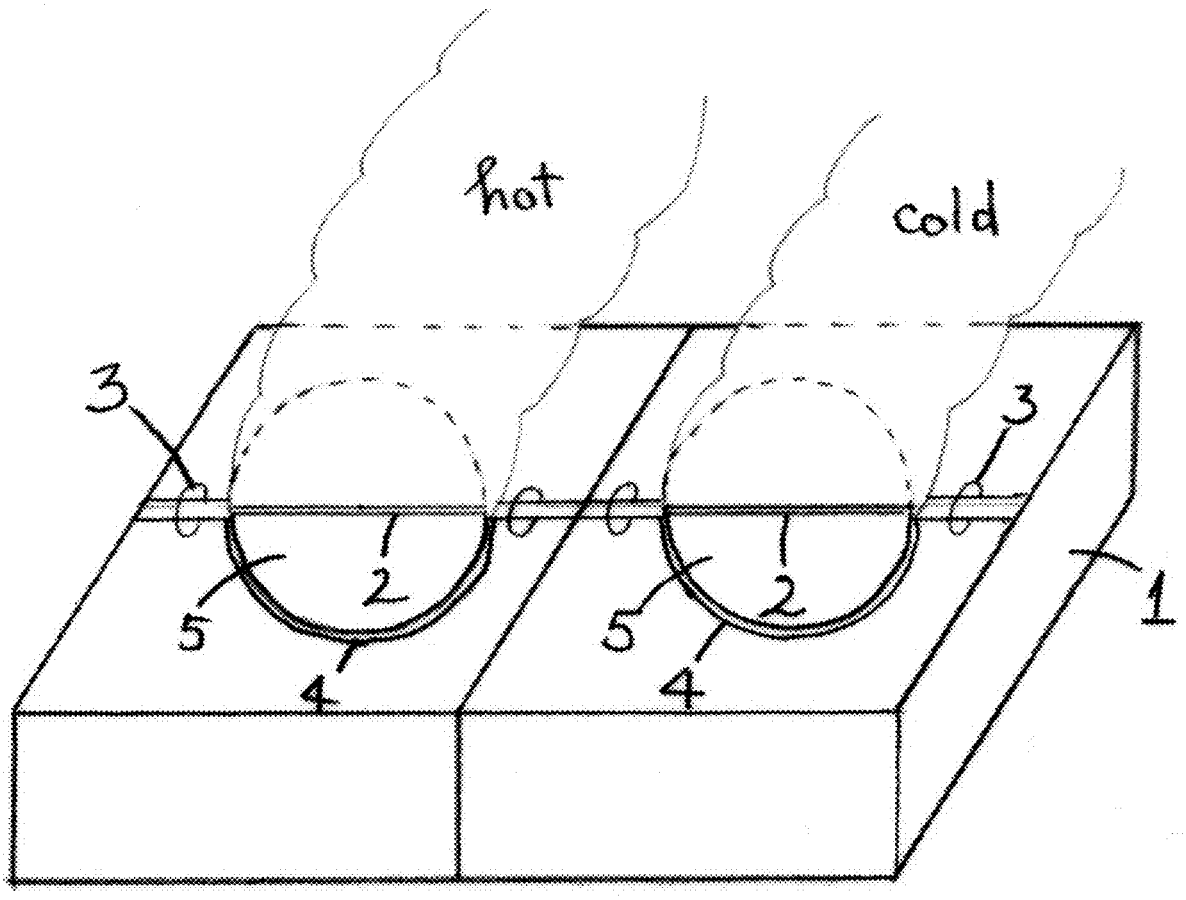
FIG. 10A is a diagram of two water supply solenoid valves when in a closed state.
Figure 10B:
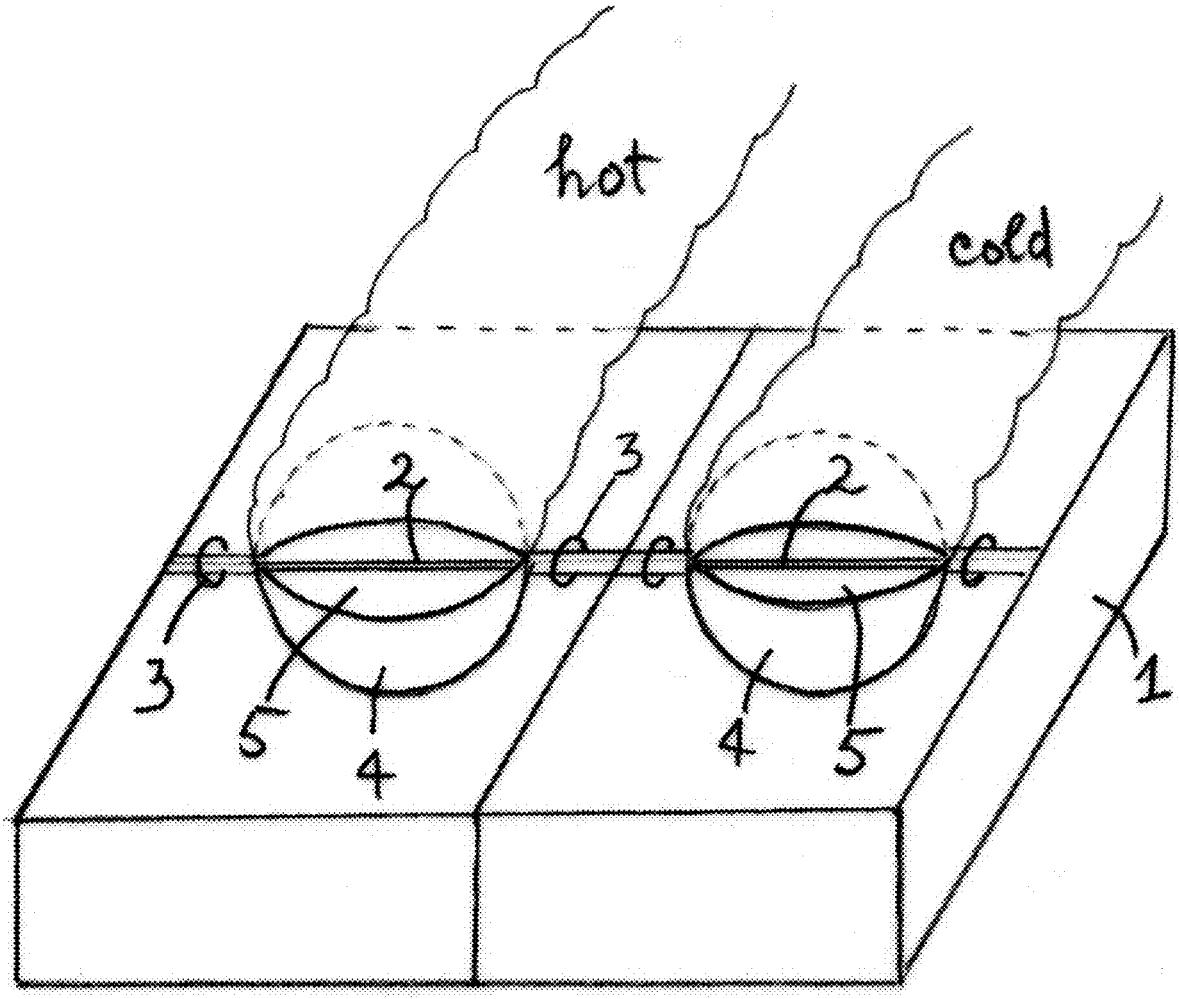
FIG. 10B is a diagram of the two water supply solenoid valves when in an open state.

FIG. 10—Hot/cold water solenoid valve
FIG. 10*a*: Close phase, FIG. 10*b*: open phase
1. Solenoid control center: (to control the axis of the valves and rotators to open and close the valves by turning it around its axis)
2. Axis of the valve
3. Rotators
4. Washer ball valve hole
5. Hot/cold water valve leaves FIG. 11—Solenoid automated detergent releasing box
Phase 1: loading, phase 2: releasing
1. Detergent & additive box with two compartments
2. Solenoid control center to open and close the slanted doors of each compartment
3. Slanted doors for detergent compartment and additive compartment
4. Detergent and additive loading door, e.g. oxyclean FIG. 12: The full machine with its shell and control panel
1. Control panel
2. Strong industrial velcro (imagined spots for the velcro)
3. The SHW Washer shell
4. The lid of the shell
5. The "imaginary line" of the washer ball situated at the center inside the shell by velcro
6. The "imaginary line" of the ball door with zipper FIG. 13—the diagram of SHW Washer operation and uses of wash mode FIG. 14—the diagram of SHW Washer of rinse and drain mode (canceled)

FIG. 15—cycles of robot hands.

The invention claimed is:

1. A system comprising:

a container having a first side, a second side, a third side, a fourth side, a bottom side, and a top side, wherein the first side is opposite the second side, wherein the third side is opposite the fourth side, and wherein the bottom side is opposite the top side;

a washer ball having an inner surface and an outer surface, wherein the washer ball is disposed within the container;

a first plurality of robotic hand structures, wherein one end of each of the first plurality of robotic hand structures is disposed along the first side of the container, and wherein another end of each of the first plurality of robotic hand structures is disposed along the outer surface of the washer ball; and a second plurality of robotic hand structures, wherein one end of each of the second plurality of robotic hand structures is disposed along the second side of the container, and wherein another end of each of the second plurality of robotic hand structures is disposed along the outer surface of the washer ball.

2. The system of claim 1, further comprising:

a lid disposed along the top side of the container.

3. The system of claim 1, further comprising:

a hot water hose attached to a top of the washer ball; and a cold water hose attached to a top of the washer ball.

4. The system of claim 1, further comprising:

a third plurality of robotic hand structures, wherein one end of each of the third plurality of robotic hand structures is disposed along the third side of the container, and wherein another end of each of the third plurality of robotic hand structures is disposed along the outer surface of the washer ball; and a fourth plurality of robotic hand structures, wherein one end of each of the fourth plurality of robotic hand structures is disposed along the fourth side of the container, and wherein another end of each of the fourth plurality of robotic hand structures is disposed along the outer surface of the washer ball.

5. The system of claim 1, wherein each of the first side of the container, the second side of the container, the third side of the container, the fourth side of the container, the bottom side of the container, and the top side of the container is detachable from the system.

6. The system of claim 1, wherein the washer ball and the robotic hand structures are detachable from the container.

7. The system of claim 1, further comprising:

a weight sensor disposed along the bottom surface of the container, wherein the weight sensor detects a weight of the washer ball.

8. The system of claim 1, wherein the washer ball has a water drain valve.

9. The system of claim 1, wherein the system includes eight robotic hand structures.

10. The system of claim 1, wherein operation of the robotic hand structures involves programmable sensors communicating with a computer program that interfaces with a control panel along a wall of the system.

11. A method comprising:

(a) inserting an amount of clothing into a washer ball disposed within a container;

(b) providing water and detergent into the washer ball; and (c) controlling a first plurality of robotic hand structures and a second plurality of robotic hand structures to expand and contract the washer ball.

12. The method of claim 11, wherein the container has a first side, a second side, a third side, a fourth side, a bottom side, and a top side, wherein the first side is opposite the second side, wherein the third side is opposite the fourth side, wherein the bottom side is opposite the top side, and wherein the clothes are inserted through the top side of the container and into the washer ball in (a).

13. The method of claim 12, wherein the washer ball has an inner surface and an outer surface, wherein one end of each of the first plurality of robotic hand structures is disposed along the first side of the container, wherein another end of each of the first plurality of robotic hand structures is disposed along the outer surface of the washer ball, wherein one end of each of the second plurality of robotic hand structures is disposed along the second side of the container, and wherein another end of each of the second plurality of robotic hand structures is disposed along the outer surface of the washer ball.

* * * * *